US012607202B2

(12) United States Patent
Li

(10) Patent No.: US 12,607,202 B2
(45) Date of Patent: Apr. 21, 2026

(54) HANGING NECK FAN

(71) Applicant: LEMOISTAR TECHNOLOGY (SHENZHEN) CO., LTD., Shenzhen (CN)

(72) Inventor: Jinpeng Li, Shenzhen (CN)

(73) Assignee: LEMOISTAR TECHNOLOGY (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 18/645,037

(22) Filed: Apr. 24, 2024

(65) Prior Publication Data

US 2025/0237235 A1 Jul. 24, 2025

Related U.S. Application Data

(63) Continuation of application No. PCT/CN2024/074503, filed on Jan. 29, 2024.

(30) Foreign Application Priority Data

Jan. 23, 2024 (CN) ..... 202420170178.X

(51) Int. Cl.
*F04D 29/60* (2006.01)

(52) U.S. Cl.
CPC ..... *F04D 29/601* (2013.01)

(58) Field of Classification Search
CPC ..... F04D 29/601; F04D 25/08
See application file for complete search history.

(56) References Cited

U.S. PATENT DOCUMENTS

| | | | | |
|---|---|---|---|---|
| 11,319,960 | B2 * | 5/2022 | Liu | F04D 29/282 |
| 2017/0035602 | A1 * | 2/2017 | Shapiro | A61F 7/007 |
| 2021/0355963 | A1 * | 11/2021 | Kang | F04D 29/281 |

* cited by examiner

*Primary Examiner* — Michael L Sehn
(74) *Attorney, Agent, or Firm* — JEEN IP LAW, LLC

(57) ABSTRACT

A hanging neck fan is provided, which includes a fan component, a fan body, and an installation portion provided on one side of the fan body; a hanging neck component wearing at a human's neck, the hanging neck component is filled with a heat absorbing medium. The hanging neck component includes a first end, a second end, and an arc-shaped main body between the first end and the second end that are sealed with each other. At least one of the first end and the second end is provided with an installation hole; and at least one connection mechanism connecting the fan component and the hanging neck component, the at least one connection mechanism includes a first portion and a second portion, the first portion is detachably connected to the hanging neck component, the second portion is detachably connected to the installation portion of the fan component.

9 Claims, 22 Drawing Sheets

A-A

B-B

C-C

D-D

E-E

F-F

G-G

H-H

K-K

L-L

N-N

O-O

P-P

R-R

HANGING NECK FAN

CROSS-REFERENCE TO RELATED APPLICATIONS

This application claims priority to Chinese Patent Application No. 202420170178.X, filed on Jan. 23, 2024; and PCT/CN2024/074503, filed on Jan. 29, 2024 which are hereby incorporated by reference in its entirety.

TECHNICAL FIELD

The present disclosure relates to a hanging neck fan.

BACKGROUND

A fan, which drives a rotation of fan blades to accelerate air circulation, is used for reliving heat and cooling. Traditional fans have larger sizes and poor portability. With the improvement of people's living standards, more and more people are engaged in outdoor sports and play, and the demand for portable fans is increasing.

A hanging neck fan is a portable fan worn around a person's neck. It is known that the hanging neck fan is provided with multiple fans on a hanging neck component in contact with the neck to blow air at multiple positions on a user's neck. However, this type of hanging neck fan requires complex inlet and outlet air ducts, which is costly. In addition, temperature blown out by the hanging neck fan is an ambient temperature. In summer outdoor environments with high temperatures, the temperature of the airflow blown out by the hanging neck fan is also higher, which causes poor cooling effect.

In order to improve the cooling effect, it is known to provide a semiconductor cooling chip on the hanging neck component for cooling. However, the power of a semiconductor cooling chip is high, which leads to an increase in power consumption.

Therefore, a hanging neck fan with a simple structure and low cost is needed to achieve good ventilation and cooling effects, and wherein the hanging neck fan is energy-saving and environmentally friendly.

SUMMARY

In response to the problems and requirements mentioned above, the present disclosure proposes a new type of hanging neck fan, which solves the above problems and brings other technical effects due to the following technical features are adopted.

In a first aspect, the present disclosure provides a hanging neck fan, including: a fan component, which includes a fan body and an installation portion provided on one side of the fan body; a hanging neck component configured to wear at a human's neck, the hanging neck component is filled with a heat absorbing medium; the hanging neck component includes a first end, a second end, and an arc-shaped main body between the first end and the second end that are sealed with each other; at least one of the first end and the second end is provided with an installation hole; and at least one connection mechanism, the at least one connection mechanism connects the fan component and the hanging neck component, the at least one connection mechanism includes a first portion and a second portion, the first portion is detachably connected to the hanging neck component, the second portion is detachably connected to the installation portion of the fan component, where the first portion is provided with an installation column that partially passes through the installation hole of the first end and/or the second end.

In some embodiments, at least one connection mechanism is formed by enclosing two half shells, at least one of the two half shells is provided with the installation column at the first portion and a connecting portion at the second portion, the connecting portion is configured to be detachably connected to the installation portion of the fan component.

In some embodiments, the installation hole is a through hole, the installation column passes through the through hole and fits with an inner wall of the through hole.

In some embodiments, the installation hole is a stepped hole structure, the stepped hole structure includes a first counter bore portion, a second counter bore portion, and a through-hole portion between the first counter bore portion and the second counter bore portion; a diameter of the through-hole portion is smaller than that of the first counter bore portion and the second counter bore portion, and thereby forming a flange between the through-hole portion with the first counter bore portion and/or the second counter bore portion, where the installation column abuts against at least one surface of the flange, or the installation column passes through the through-hole portion.

In some embodiments, one of the connecting portion and the installation portion is provided with a connecting rod, one end of the connecting rod is provided with a spherical connecting head, the other of the connecting portion and the installation portion is provided with a spherical cavity to accommodate the spherical connecting head, where the hanging neck fan further includes a locking structure, the spherical connecting head and the spherical cavity are locked or unlocked with each other through the locking structure; the spherical connecting head is fixed in the spherical cavity when locked, and the spherical connecting head can rotate or separate from the spherical cavity when unlocked.

In some embodiments, the locking structure includes an external thread where at least a part of the external thread surrounds the spherical cavity, and a nut that fits with the external thread; the spherical connecting head is accommodated in the spherical cavity, engages with the external thread and be locked through the nut, where the external thread has multiple grooves distributed along a circumference, the multiple grooves extend along an axial direction so that the external thread is tightened radially to fix the spherical connecting head in the spherical cavity when locked.

In some embodiments, the installation portion is provided with the connecting rod, the connecting portion is provided with the spherical cavity, the connecting portion is provided with a sliding groove along an axial direction and a movable slider in the sliding groove, the slider can move between a locking position and an unlocking position, the slider can be coupled with the spherical connecting head of the connecting rod and hinder the spherical connecting head to separate from the spherical cavity when in the locking position; the slider can separate from the spherical connecting head of the connecting rod and the spherical connecting head can separate from the spherical cavity when in the unlocking position.

In some embodiments, the locking structure includes a magnet provided in the spherical cavity, the spherical connecting head is made of iron material, where the spherical connecting head is placed into the spherical cavity and magnetically attracted to the magnet in the spherical cavity.

In some embodiments, one of the connecting portion and the installation portion is provided with a connecting rod, one end of the connecting rod is provided with a spherical connecting head, the other of the connecting portion and the installation portion is provided with a spherical cavity to accommodate the spherical connecting head, where the spherical connecting head is clearance-fit with the spherical cavity or coupled with the spherical cavity by a soft adhesive.

In some embodiments, the heat absorbing medium is a phase change material, gel material or oil.

BRIEF DESCRIPTION OF DRAWINGS

In order to provide a clearer explanation of the technical solution of the disclosed embodiments, a brief introduction will be given below to the accompanying drawings of the embodiments. It is obvious that the accompanying drawings in the following description only relate to some embodiments of the disclosure, rather than limiting the disclosure.

DESCRIPTION OF EMBODIMENTS

Figure 1:
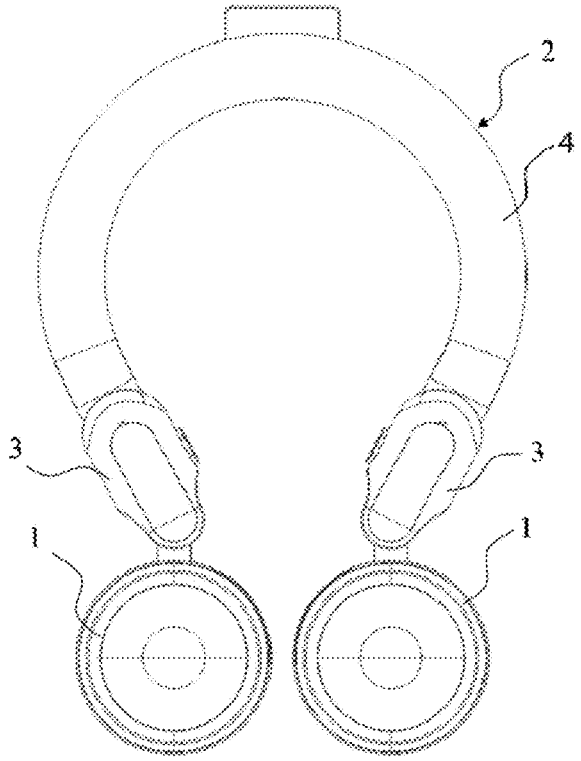
FIG. 1 shows a front view of a hanging neck fan according to at least one embodiment of the present disclosure.
Figure 2:
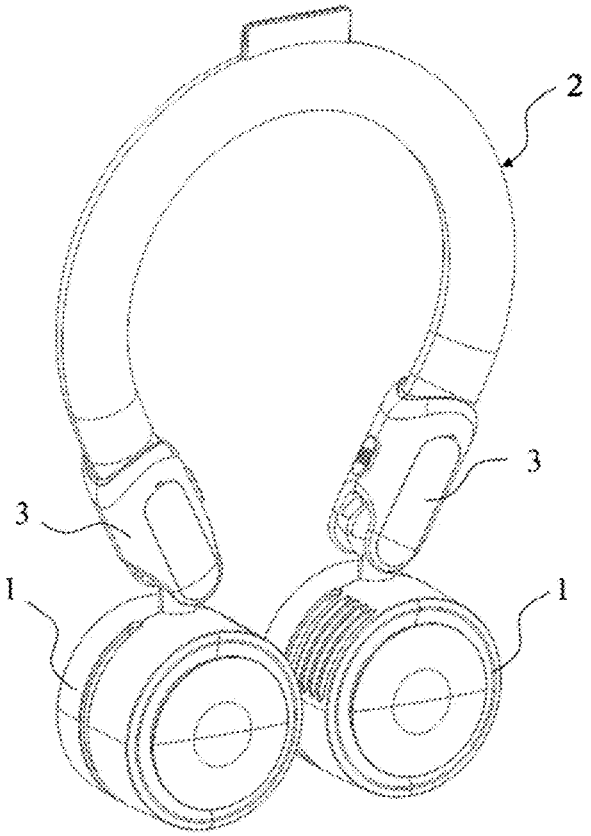
FIG. 2 shows a perspective view of the hanging neck fan according to at least one embodiment of the present disclosure.

In order to render the purpose, technical solution, and advantages of the disclosed technical solution clearer, the following description will combine the drawings of the specific embodiments of the present disclosure to provide a clear and complete description of the technical solution of the embodiments of the present disclosure. The same number reference in the drawings represents the same component. It should be noted that the described embodiments are a part of the embodiments of the present disclosure, not the entire embodiments. Based on the described embodiments disclosed herein, all other embodiments obtained by those skilled in the art without the need for creative work fall within the protection scope of the present disclosure.

Unless otherwise defined, technical or scientific terms used herein shall have the usual meaning understood by those skilled in the art to which the present disclosure belongs. Terms "first", "second", and similar terms used in the present application and claims do not indicate any order, number, or importance, but are only used to distinguish different components. Similarly, words like "a/an" or "one" do not necessarily indicate the number limit. Words such as "including" or "include" refer to components or objects that appear before the word, including those listed after the word and their equivalents, without excluding other components or objects. Words like "connection to" or "connection with" are not limited to physical or mechanical connections, but can include an electrical connection, whether direct or indirect. "Up", "down", "left", "right", etc. are only used to represent a relative positional relationship. When an absolute position of the described object changes, a relative positional relationship may also change accordingly.

The following is a detailed explanation of the embodiment of the hanging neck fan according to the present disclosure, combined with the accompanying drawings.

Compared with the embodiments shown in the accompanying drawings, feasible embodiments within the scope of the present disclosure may have fewer components, other components not shown in the drawings, different components, members arranged differently, or components connected differently. Furthermore, without departing from the concepts disclosed herein, two or more components in the drawings may be implemented in a single component, or the single component shown in the drawings may be implemented as multiple separate components.

Hanging neck fan is a portable fan worn around a person's neck. It is known that a hanging neck fan is provided with multiple fans on a hanging neck component in contact with the neck to blow air at multiple positions on a user's neck. However, this type of hanging neck fan requires complex inlet and outlet air ducts, which is costly. In addition, the temperature blown out by the hanging neck fan is the ambient temperature. In summer outdoor environments with high temperatures, the temperature of the airflow blown out by the hanging neck fan is also higher, which causes poor cooling effect.

In addition, in order to improve a cooling effect, it is known to provide a semiconductor cooling chip on the hanging neck component for cooling. However, the power of semiconductor cooling chip is relatively high, which leads to an increase in power consumption.

Elements filled with a heat absorbing medium, such as a phase change material, gel material or oil, can absorb heat by changing the properties of solid and liquid, or by their own high specific heat capacity. This heat absorbing element can be attached to the human body, thereby playing a role of cooling and refreshing.

In response to the shortcomings of existing technology, the present disclosure proposes a new type of hanging neck fan, which detachably connects the hanging neck component filled with a heat absorbing medium and the fan together, achieving good ventilation and cooling effects with a simple structure and low cost, and is energy-saving and environmentally friendly. The following will provide an exemplary description of embodiments of the hanging neck fan proposed in the present disclosure, with reference to the accompanying drawings.

FIGS. 1 to 6 illustrate a hanging neck fan according to at least one embodiment of the present disclosure. As shown in FIG. 1, the hanging neck fan includes a fan component 1, a hanging neck component 2, and at least one connection mechanism 3 connecting the fan component 1 and the hanging neck component 2. In the embodiments shown in FIGS. 1 and 2, two fan components 1 and corresponding two connection mechanisms 3 are shown. The number of fan component and connection mechanism may be more or less, and the present disclosure is not limited to this. The connection mechanism 3 can detachably connect the fan component 1 and hanging neck component 2 together.

The hanging neck component 2 is formed as a whole in a curved shape that fits a human's neck, which can be comfortably worn on the human's neck and fits on surface of the skin at the neck. The hanging neck component 2 is made of polymer materials, such as polyurethane (TPU) material, which is filled with a heat absorbing medium. The heat absorbing medium may be, for example, a phase change material, a gel material or oil.

Phase Change Material (PCM) refers to a substance that changes its shape with temperature and can provide latent heat. A process by which the phase change material changes from solid to liquid or from liquid to solid is called a phase change process. At this time, the phase change material will absorb or release a large amount of latent heat. Water is a most common phase change material, when the temperature drops to 0° C., water changes from liquid to solid (freezing). When the temperature is above 0° C., water changes from solid to liquid (melts). During a freezing process, a large amount of cold energy is absorbed and stored, while during a melting process, a large amount of thermal energy is absorbed. For this embodiment, in addition to water, in an implementation mode, the phase change material can be a solid-liquid phase change material, with a phase change temperature (or solidification point) around room temperature (16° C. to 33° C.), such as advanced fatty hydrocarbons (n-hexadecane, n-octadecane, paraffin, etc.), fatty acids and their esters (stearic acid, palmitic acid, etc.), crystalline hydrated salts ($Na_2SO_4 \cdot 10H_2O$, $Mn(NO_3)_2 \cdot 6H_2O$, etc.), molten salts (LiF, NaF, $CaF_2$, etc.), metals and alloys (lead tin alloys, etc.), and polymers (polyethylene glycol, etc.).

In an actual use, the hanging neck component 2 filled with a phase change material can be stored at a low temperature for a period of time, and then taken out. At this time, the phase change material is in a solid state. Then the hanging neck component 2 is connected to the fan component 1 through the connection mechanism 3, so that it can be hung at the human's neck for cooling and ventilation. Due to a detachable connection between the hanging neck component 2 and connection mechanism 3, when the temperature of the phase change material in the hanging neck component 2 approaches a room temperature and the cooling effect deteriorates, the hanging neck component 2 can be dissembled and replaced with a new hanging neck component 2 that has been stored at low temperature, thus, it is convenient to replace.

How to detachably connect the hanging neck component 2 to the connection mechanism 3 in a simple and cost-effective way is a technical problem that needs to be solved. Firstly, TPUs filled with the phase change material are difficult to form a separate connecting shell, and may require a separate external shell for connection to wrap around the TPU material, with additional elastic members providing compliance and flexibility, which causes complex structures and higher costs. And due to the TPU material is not directly adhering to the human skin, the cooling effect is also affected.

Therefore, the present disclosure provides a new connection way by proving with an installation hole at at least one end of the hanging neck component, which is connected to the connection mechanism through a hole-column connection way. This connection way is simple and cost-effective, without the need for additional shells or connectors on the hanging neck component.

In addition, the present disclosure further proposes a process method for manufacturing such hanging neck component, which can include the following steps:

S1. Providing a TPU material with an opening at at least one end and being hollow;

S2. Injecting a heat absorbing medium into the TPU material;

S3. Pressing an opening end of the TPU material tightly and fusing into one with an ultrasonic welding;

S4. Processing a through hole at a fused part.

It should be noted that the hanging neck component can also be connected to the connection mechanism with an adhesion agent or a glue instead of proving with the installation hole.

Figure 3:
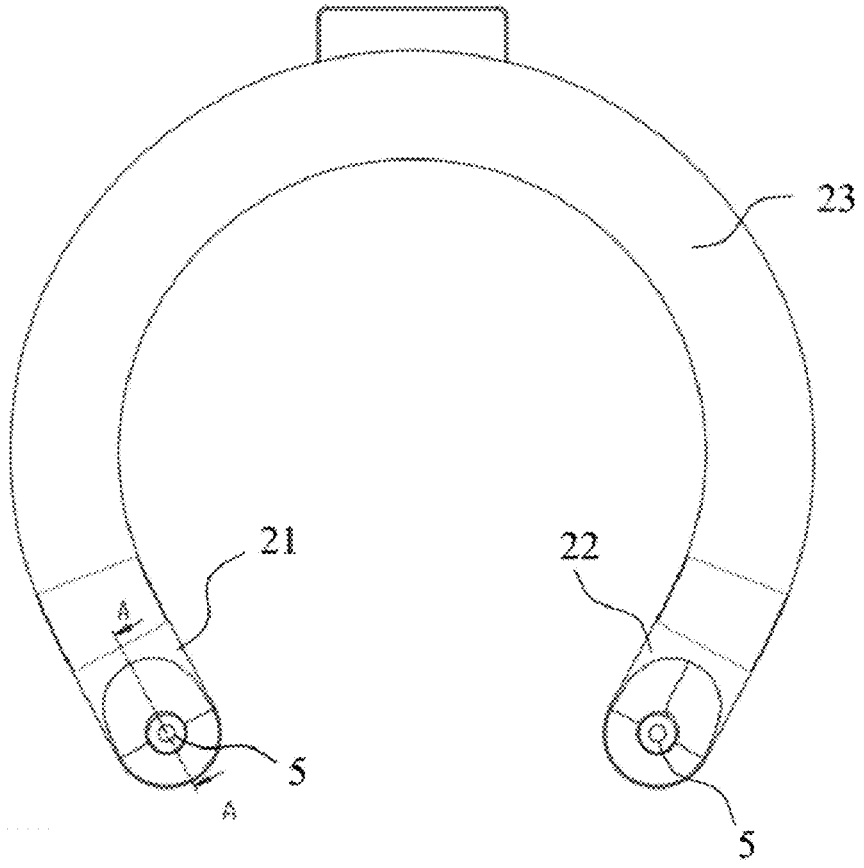
FIG. 3 shows a front view of a hanging neck component according to at least one embodiment of the present disclosure.
Figure 4:
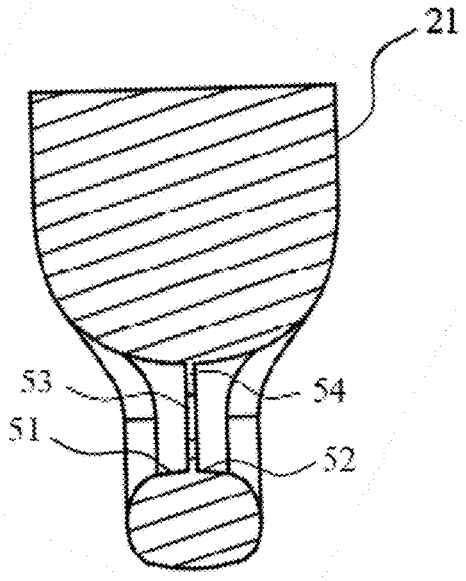
FIG. 4 shows a partial sectional view taken along line A-A of FIG. 3.
Figure 5:
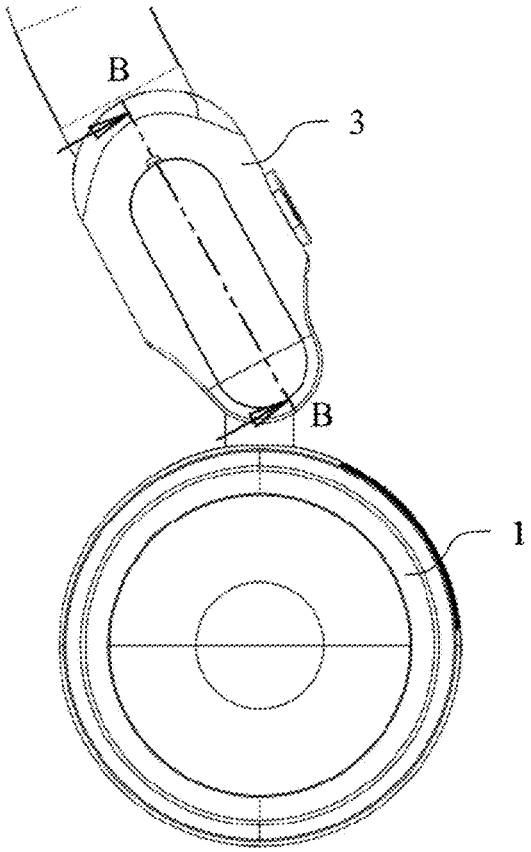
FIG. 5 shows a partial view of the hanging neck fan shown in FIG. 1.

FIGS. 3 and 4 further exemplify show the structure of the installation hole 5 of the hanging neck component 2. As shown in FIG. 4, the installation hole 5 can be a step hole structure, which includes a first counter bore portion 51, a second counter bore portion 52, and a through-hole portion 53 between the first counter bore portion 51 and the second counter bore portion 52. A diameter of the through-hole portion 53 is smaller than that of the first counter bore portion 51 and second counter bore portion 52, and thereby forming a flange 54 between the through-hole portion 53 with the first counter bore portion 51 and/or the second counter bore portion 52. For example, the first counter bore portion 51 and second counter bore portion 52 may be symmetrically arranged relative to the through-hole portion 53.

Returning to the embodiments in FIGS. 1 to 6, the connection mechanism 3 includes a first portion 31 and a second portion 32 in an axial direction, which are respectively configured to connect the hanging neck component 2 and the fan component 1. The first portion 31 is detachably connected to the hanging neck component 2, the second portion 32 is detachably connected to the fan component 1.

Figure 6:
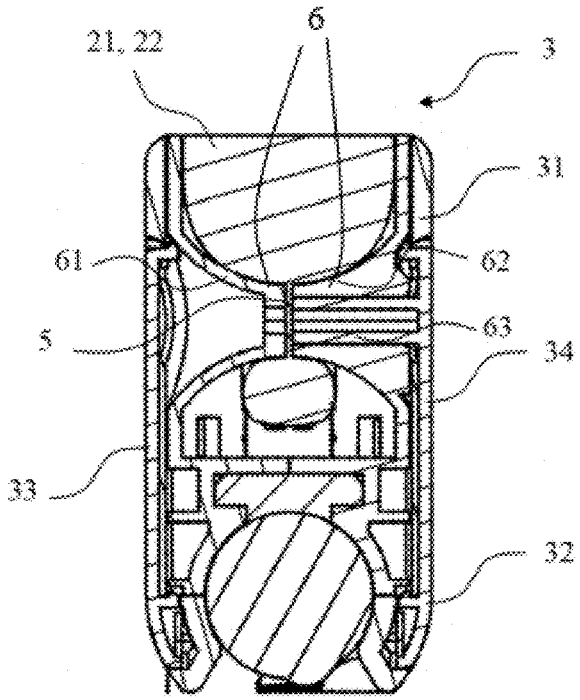
FIG. 6 shows a cross-sectional view taken along line B-B of FIG. 5.

As shown in a cross-sectional view of FIG. 6, the connection mechanism 3 is formed by enclosing two half shells, respectively referred to as a first shell 33 and a second shell 34. Each shell 33, 34 may include a cover and a main body provided with installation columns 61, 62, the cover and main body may be connected by a buckle, for example. In the embodiment shown in FIG. 6, the first installation column 61 abuts against one surface of the flange 54 of the installation hole 5, the second installation column 62 abuts against another surface opposite to that surface of the flange 54 of the installation hole 5.

FIG. 6 shows two optional embodiments of the installing column 6, respectively.

One side wall of the first installation column 61 of the first shell 33 has an arc-shaped surface that fits with the first counter bore portion 51 and/or the second counter bore portion 52 of the first end 21 or the second end 22 of the hanging neck component 2. One end of the first installation column 61 in contact with the flange 54 has a diameter roughly equal to a size of the flange 54, the other end opposite to said end is provided as an opening structure. The cover can close the opening structure.

One side wall of the second installation column 62 of the second shell 34 may also have an arc-shaped surface that fits with the first counter bore portion 51 and/or the second counter bore portion 52 of the first end 21 or the second end 22 of the hanging neck component 2, and an end of the second installation column 62 contacting with the flange 54 also has a diameter roughly equal to a size of the flange 54. The difference is that the second installation column 62 has a through-hole structure that is intercommunicated and is arranged coaxially with the second installation column 62, the through-hole structure accommodates a third installation column 63 provided on the cover that matches it. The third installation column 63 passes through the through-hole structure of the second installation column 62 and abuts against one surface of the flange 54 together with an end of the second installation column 62. In an implementation mode, the first installation column 61, the second installation column 62, the third installation column 63, and the through-hole portion 53 are coaxial with each other.

The installation column 6 of the above two structures can be used in combination or separately. In an implementation mode, when the installation columns 6 with two structures are used in combination, two mirror symmetrical connection mechanisms 3 can reuse the installation columns 6 with the two structures. The only difference is that the order of the two can be reversed. Correspondingly, the order of the first shell 33 and the second shell 34 can also be reversed, which can save mold manufacturing costs. All parts used for the two connection mechanisms 3 can be produced with one set of molds.

When installing the hanging neck component 2, first counter bore portion 51 of the first end 21 or the second end 22 of the hanging neck component 2 is firstly fit with the first installation column 61 of the first shell 33, then the second installation column 62 of the second shell 34 is fit with the second counter bore portion 52, the third installation column 63 of the cover of the second shell 34 is finally inserted into the through-hole structure of the second installation column 62, and the flange 54 is pressed tightly. On the contrary, when disassembling the hanging neck component 2, the cover of the second shell 34 and its third installation column 63 are first drawn from the through-hole structure of the second installation column 62, then the second installation column 62 is separated from the second counter bore portion 52, so as the first end 21 or the second end 22 of the hanging neck component 2 is separated from the first shell 33.

In an embodiment, the installation hole 5 can be configured as a through hole, the installation column 6 directly passes through the through hole and fits with an inner wall of the through hole.

In addition to the connection between the end of the hanging neck component and the connecting module, the present disclosure further proposes various connection ways for the fan component and the connecting module. The following will provide a detailed description in combination with the accompanying drawings. It should be noted that those skilled in the art may use one or more of the connection way disclosed in the present disclosure, or a combination thereof.

FIGS. 7 to 12 exemplify show the hanging neck fan according to at least one embodiment of the present disclosure, which show an optional connection way between the fan component and the connection mechanism.

Figure 10:
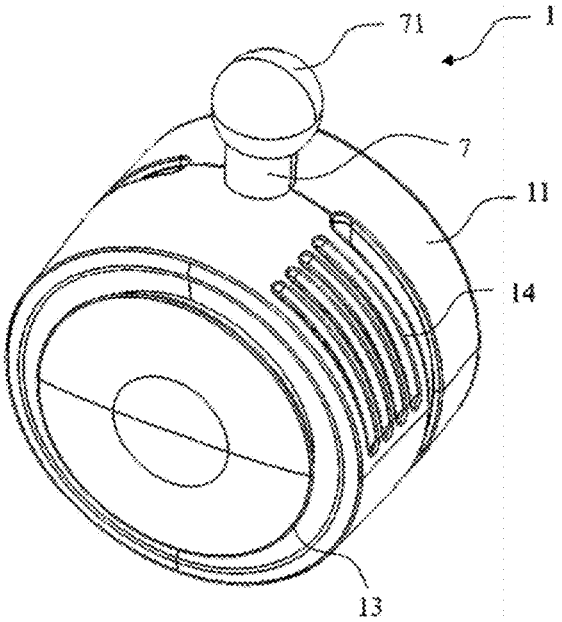
FIG. 10 shows a perspective view of the fan component according to at least one embodiment of the present disclosure.
Figure 11:
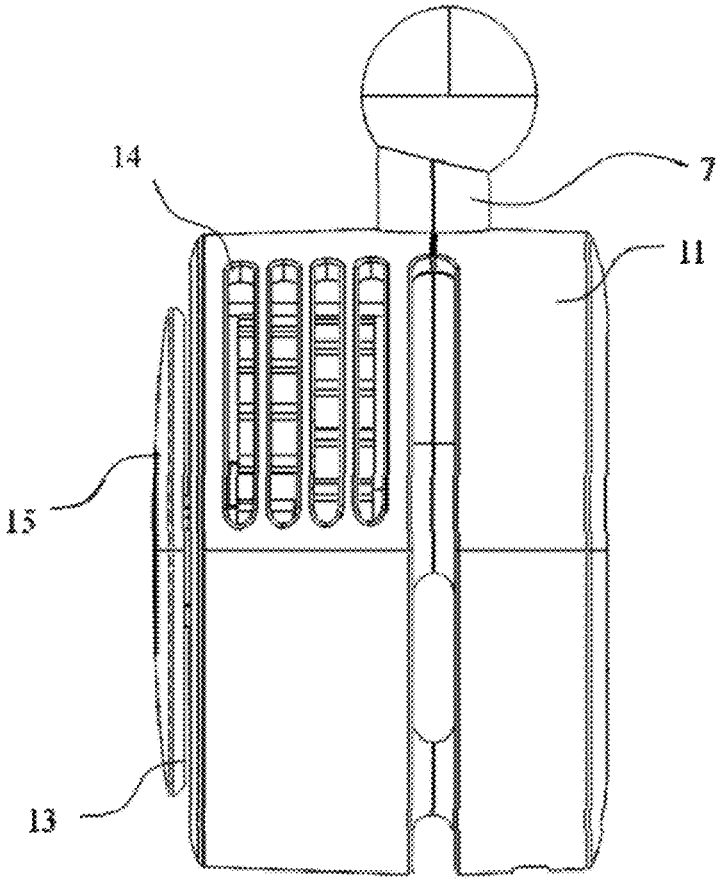
FIG. 11 shows a side view of the embodiment shown in FIG. 10.
Figure 12:
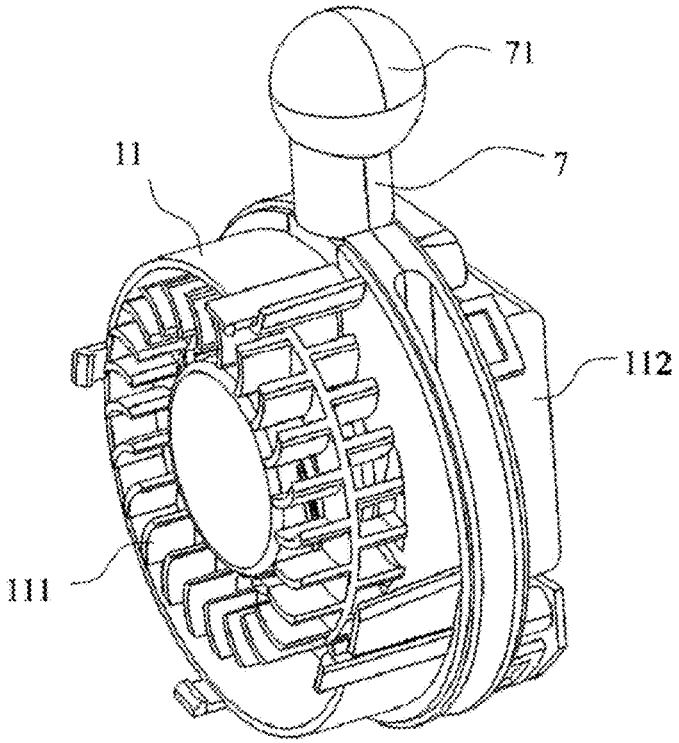
FIG. 12 shows another perspective view of the embodiment shown in FIG. 10, where an outer shell of the fan body is omitted.
Figure 13:
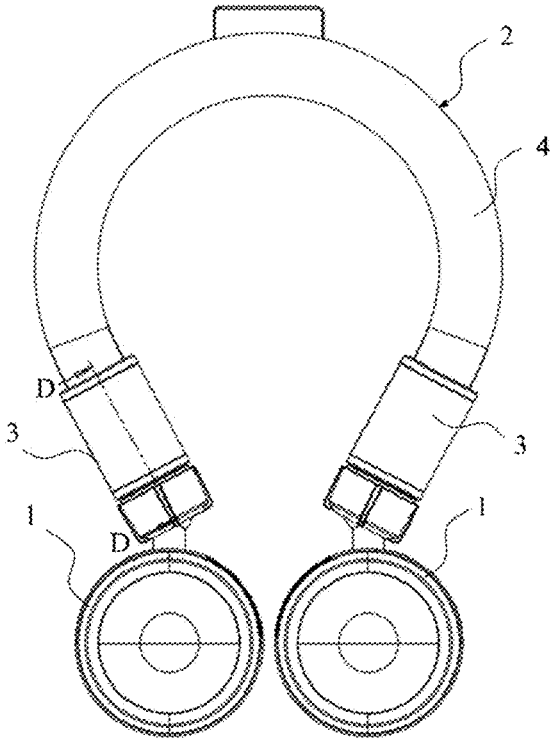
FIG. 13 shows a front view of the hanging neck fan according to another embodiment of the present disclosure.

As shown in FIGS. 10 to 12, the fan component 1 may include a fan body 11 and an installation portion 12 provided on one side of the fan body. The fan body 11 has a roughly cylindrical contour, on which an air inlet 13 and an air outlet 14 are provided. The air inlet 13 is provided on an opening of a top surface of the fan body 11 and can be surrounded by an upper cover 15 that partially covers the opening. There is a gap between the upper cover 15 and the opening of the top surface of the fan body 11, through which air can enter the fan body 11. The air outlet 14 is provided around a circumferential side wall of the fan body 11, in an implementation mode, the air outlet 14 faces the neck or face of the human. For example, the air outlet 14 includes multiple grooves that are parallel arranged along a circumferential sidewall and the grooves are intercommunicated.

As shown in FIG. 12, the fan body 11 is provided with a fan blade assembly 111 and a drive motor 112. The drive motor 112 is configured to drive the fan blade assembly 111 to rotate, thereby generating airflow and continuously outputting airflow to the human body. In order to facilitate the air outlet from one side wall of the fan body 11, the fan blade assembly 111 is non-concentric with the fan body 11, and in an implementation mode, it is to set a distance from an edge of the fan blade assembly 11 to an inner wall of the fan body 11 to be gradually spaced, a maximum distance is reached at the air outlet 14. For the sake of simplicity, the present disclosure omits other components of the fan component 1 that are less related to the concept of the present disclosure, such as battery, control circuit board, wire, and other common components of fan components. Those skilled in the art can adjust and provide them according to an actual need.

Figure 8:
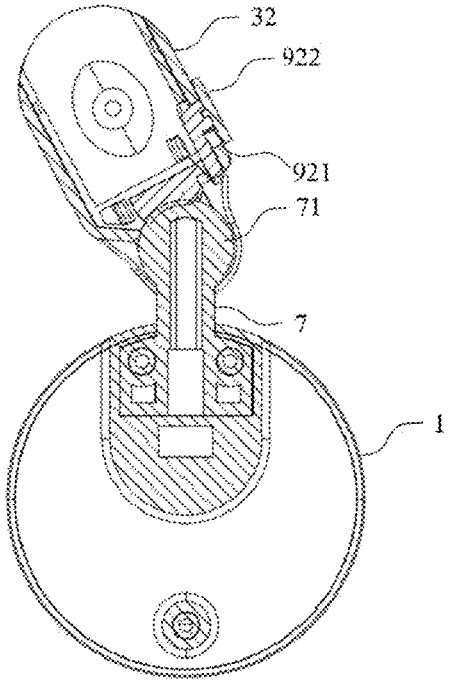
FIG. 8 shows a cross-sectional view taken along line C-C of FIG. 7, which illustrates an embodiment of a locking mechanism with a slider in an unlocking position.

Referring to FIGS. 8 and 10, the installation portion 12 is provided with a connecting rod 7, which extends from a side wall of the fan body 11, an end of the connecting rod 7 is provided with a spherical connecting head 71. As shown in a cross-sectional view of FIG. 8, a screw hole can be provided at a bottom of the connecting rod 7, which is installed on the fan body 11 through a screw.

Figure 7:
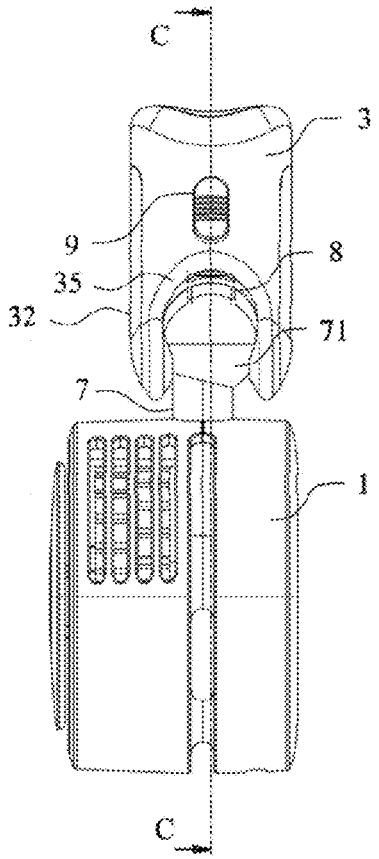
FIG. 7 shows a side view of the hanging neck fan according to at least one embodiment of the present disclosure, where the hanging neck component is omitted.

As shown in FIG. 7, a connecting portion 35 is provided at the second portion 32 of the connection mechanism 3. A side of the connecting portion 35 has an opening, a spherical cavity 8 is provided to accommodate the spherical connection head 71. A size of the spherical cavity 8 is basically matched with that of the spherical connection head 71. The spherical connection head 7 can enter the spherical cavity 8 from a side opening of the connecting portion 35 to allow the spherical connection head 7 to freely rotate along the surface of the spherical cavity 8, so that a spatial angle of the fan component 1 relative to the connection mechanism 3 can be flexibly adjusted to adjust an appropriate outlet angle for blowing towards the human body.

In order to fix the position of the spherical connecting head 71, the hanging neck fan further includes a locking structure 9, the spherical connecting head 71 and the spherical cavity 8 are locked or unlocked with each other through the locking structure 9. Specifically, during locking, the spherical connecting head 71 is fixed in the spherical cavity 8; when unlocked, the spherical connecting head 71 can rotate within or separate from the spherical cavity 8.

It should be noted that "the spherical connecting head 71 being fixed in the spherical cavity 8" can include two situations: one is that the spherical connecting head 71 is completely fixed in the spherical cavity 8, at this time, the spherical connecting head 71 cannot move or rotate relative to the spherical cavity 8; the other is that the spherical connecting head 71 cannot separate from the spherical cavity 8, but can rotate at a certain angle.

Figure 9:
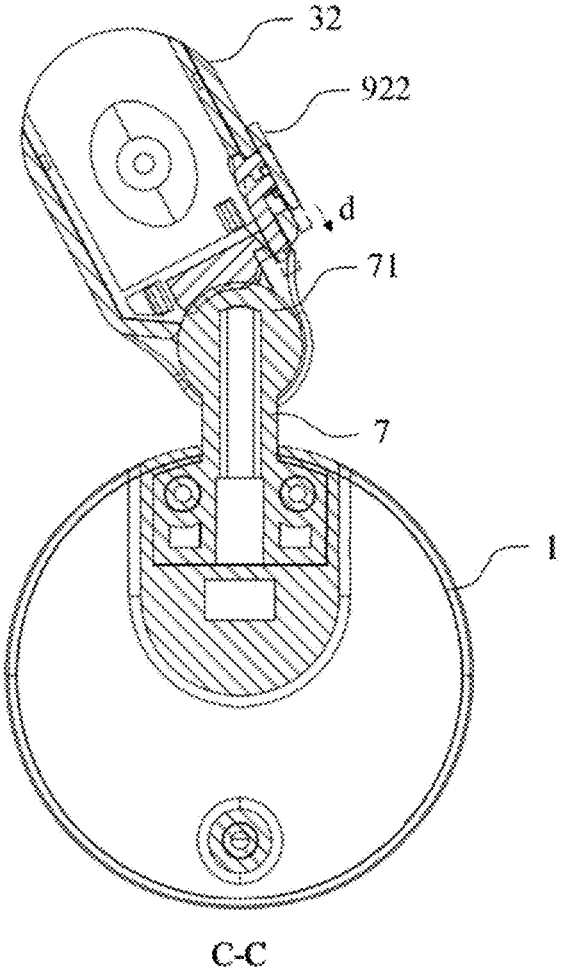
FIG. 9 shows two positions of the slider in the embodiment shown in FIG. 8, where the slider in the unlocking position is shown in solid lines and the slider in a locking position is shown in dashed lines.

FIGS. 8 and 9 illustrate one embodiment of the locking structure 9. The connecting portion 35 is provided with a sliding groove 921 along an axial direction and a movable slider 922 in the sliding groove 921, the slider 922 can move between a locking position and an unlocking position. In this embodiment, the slider 922 is provided on an opening on one side of the connecting portion 35.

In the unlocking position, as shown in FIG. 8, the slider 922 is separated from the spherical connecting head 71 of the connecting rod 7, the spherical connecting head 71 can be separated from the spherical cavity 8. In other words, in the unlocking position, the spherical connecting head 71 can also be installed into the spherical cavity 8.

After installing the spherical connecting head 71 into the spherical cavity 8, it can be moved down a certain distance d along an axial direction (a direction of a arrow in FIG. 9). At this time, the slider 922 reaches a downward extreme position in the sliding groove (represented by a dashed line in FIG. 9), the locking structure 9 is in the locking position. In the locking position, the slider 922 is able to couple with the spherical connecting head 71 of the connecting rod 7 and hinder the spherical connecting head 71 to separate from the spherical cavity 8. Specifically, due to the limitation of the slider 922, the spherical connecting head 71 cannot be moved out of the opening on the side of the connecting portion 35.

FIGS. 13 to 16 exemplarily illustrate the hanging neck fan in yet one embodiment of the present disclosure. For the sake of simplicity, the following will mainly describe the differences between this embodiment and the aforementioned embodiments. The structure of the undescribed parts can refer to the aforementioned embodiments and will not be repeated here. This description manner is also applicable to all embodiments described below.

In this embodiment, the locking structure 9 includes an external thread 911 that partially surrounds the spherical cavity 8 and a nut 912 that fits with the external thread 911. The spherical connecting head 71 is accommodated within the spherical cavity 8 and can be engaged and locked with the external thread 911 through the nut 912. The external thread 911 has multiple grooves 913 distributed along a circumference, the multiple grooves 913 extend along the axial direction, which allows the external thread 911 to move radially by a certain amount. Therefore, during locking, the external thread 911 can tighten radially to fix the spherical connecting head 71 in the spherical cavity 8. The external thread 911 can be made of hard plastic with a certain elasticity, for example.

Figure 15:
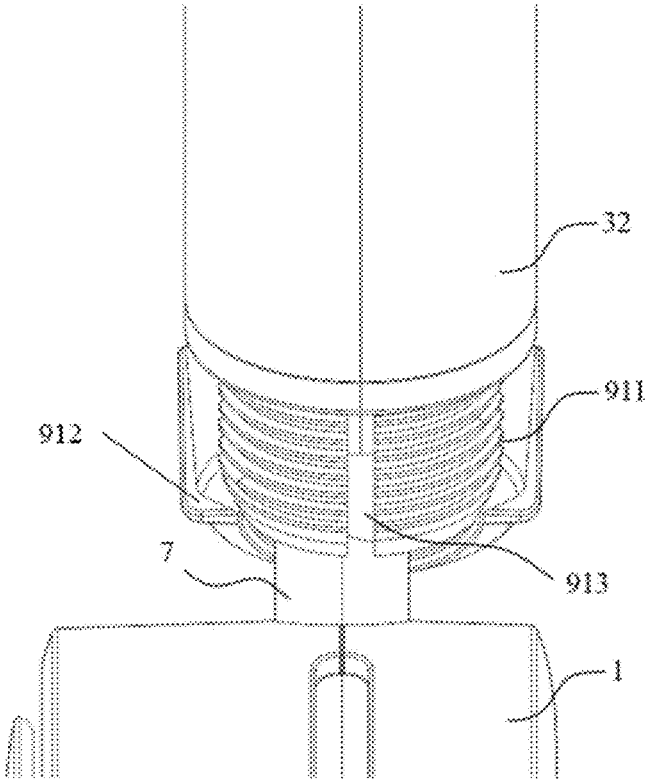
FIG. 15 shows a local side view of the embodiment shown in FIG. 13.

In an implementation mode, the groove 913 can also be formed by splicing two half grooves of a halves of the two shells 33 and 34, as shown in FIG. 15.

The fan component 1 can be connected to the connection mechanism 3 through the following steps. The nut 912 is firstly unscrewed from the external thread 911 and sleeved on the connecting rod 7. Then, the spherical connecting head 71 of the fan component 1 is extended into the spherical cavity 8. The nut 912 is finally tighten into the external thread 911 radially to secure the spherical connecting head 71 to be fixed in the spherical cavity 8. Conversely, the nut 912 is unscrewed from the external thread 911, the spherical connecting head 71 can be removed from the spherical cavity 8.

Figure 14:
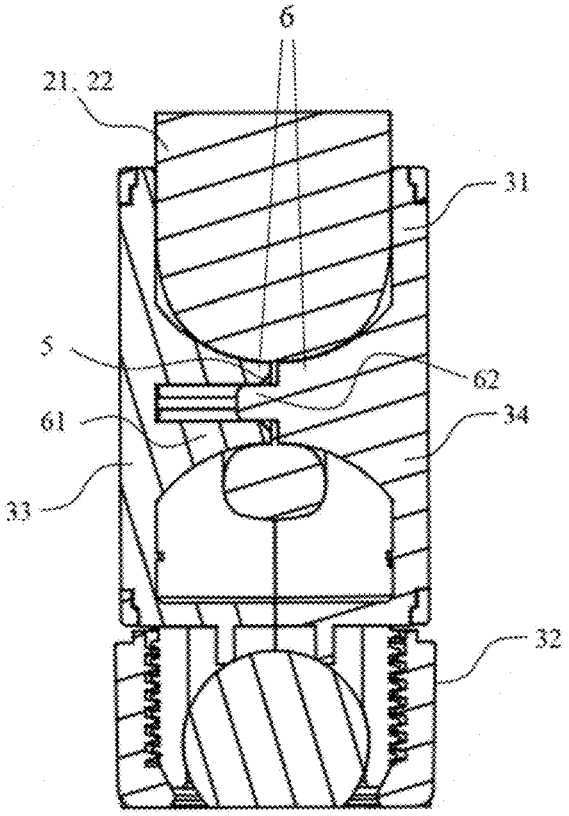
FIG. 14 shows a partial sectional view taken along line D-D of FIG. 13.
Figure 16:
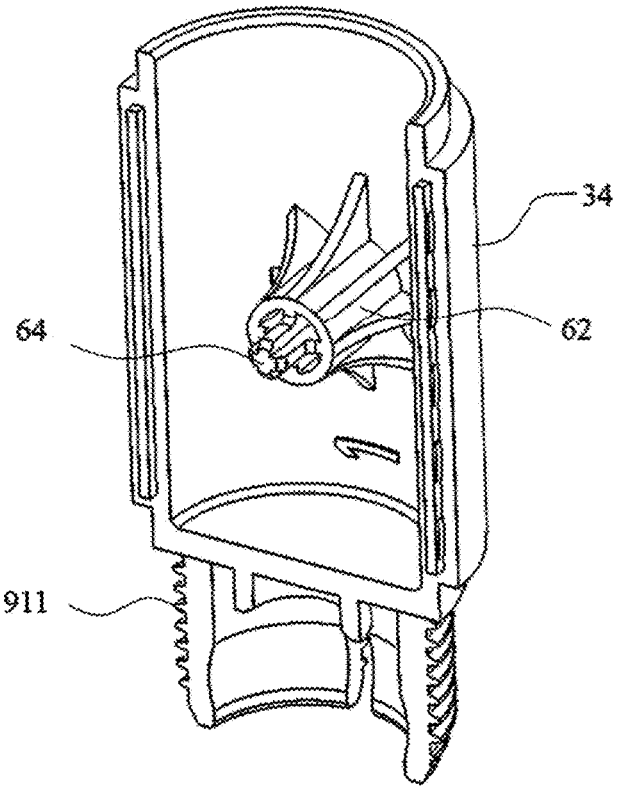
FIG. 16 shows a component diagram of a second shell of the embodiment shown in FIG. 13.

Furthermore, in this embodiment, a protrusion 64 may be provided at an end of the second installation column 62 of the second shell 34, a cross-section of the protrusion 64 may be a cross shape, hexagonal, or in a shape of character "—", for example. The protrusion 64 passes through the through-hole portion 53 of the installation hole 5 and fits with an inner wall of the through-hole portion 53, as shown in FIGS. 14 and 16.

Figure 17:
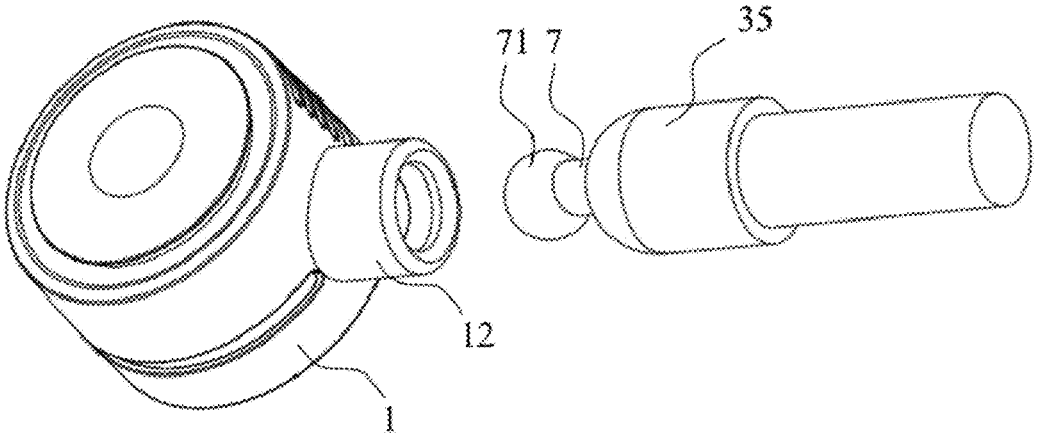
FIG. 17 shows a partial perspective view of the hanging neck fan according to yet one embodiment of the present disclosure.
Figure 18:
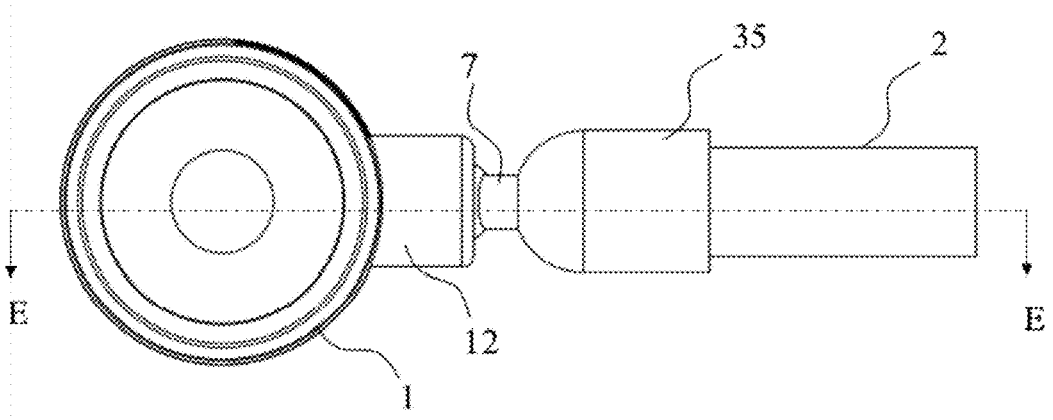
FIG. 18 shows a partial side view of the hanging neck fan according to yet one embodiment of the present disclosure.
Figure 19:
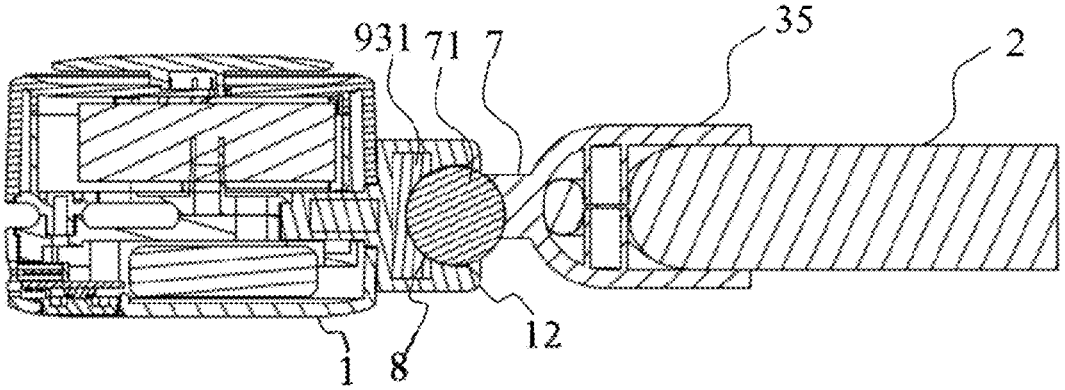
FIG. 19 shows a cross-sectional view taken along line E-E of FIG. 18.

FIGS. 17 to 19 exemplify show the hanging neck fan in yet one embodiment of the present disclosure. Unlike the previous embodiments, the locking structure 9 of this embodiment includes a magnet 931 provided in the spherical cavity 8. The spherical connecting head 71 is made of iron material, so it can be inserted into the spherical cavity 8 and magnetically attracted to the magnet 931 in the spherical cavity 8. When separation is required, only an external force needs to be applied to overcome the magnetic force to pull out the spherical connecting head 71.

In the embodiments of FIGS. 17 to 19, the connecting portion 35 of the connection mechanism 3 is provided with a connecting rod 7, an end of the connecting rod 7 is provided with a spherical connecting head 71. The installation portion 12 of the fan component 1 is provided with a spherical cavity 8 to accommodate the spherical connecting head 71.

Figure 20:
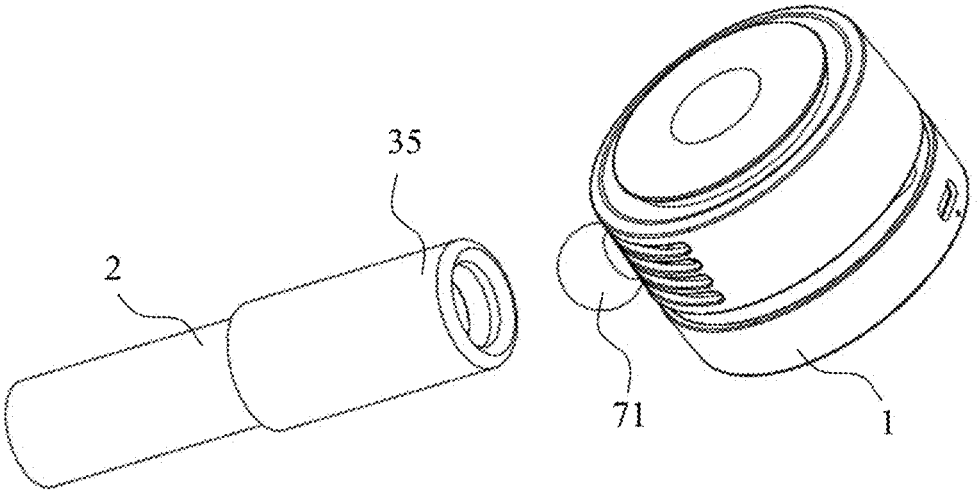
FIG. 20 shows a partial perspective view of the hanging neck fan according to yet one embodiment of the present disclosure.
Figure 21:
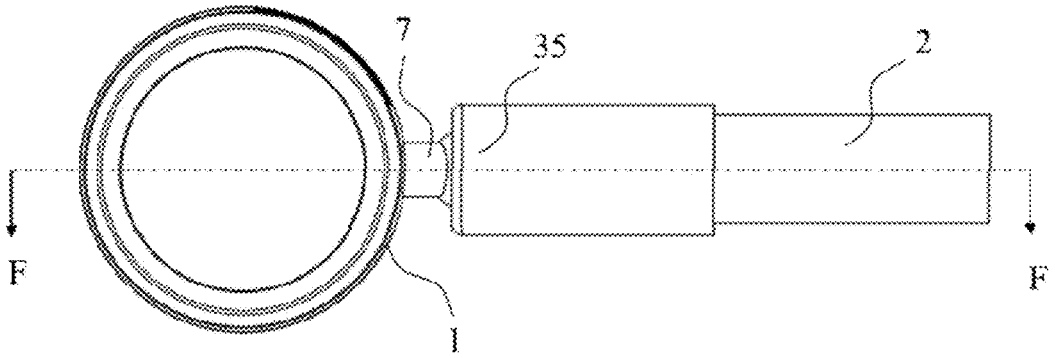
FIG. 21 shows a partial side view of the hanging neck fan according to yet one embodiment of the present disclosure.
Figure 22:
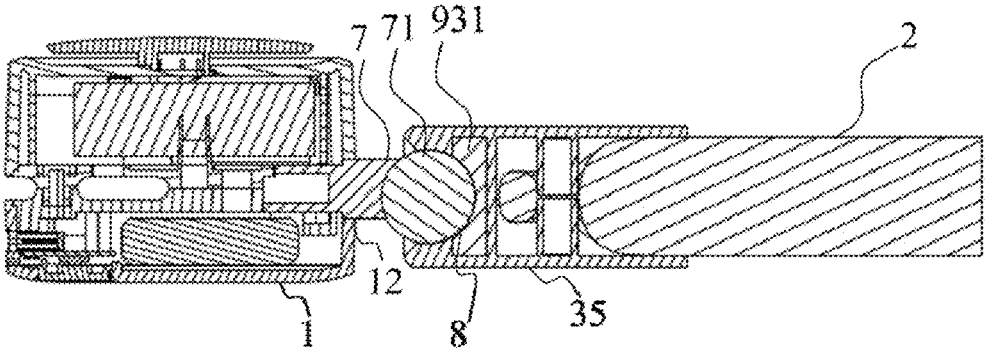
FIG. 22 shows a cross-sectional view taken along line F-F of FIG. 21.

FIGS. 20 to 22 exemplarily illustrate the hanging neck fan in yet one embodiment of the present disclosure. Unlike the previous embodiment, the spherical cavity 8 of this embodiment is provided at the connecting portion 35 of the connection mechanism 3, the connecting rod 7 and the spherical connection head 71 are provided at the installation portion 12 of the fan component 1.

Figure 23:
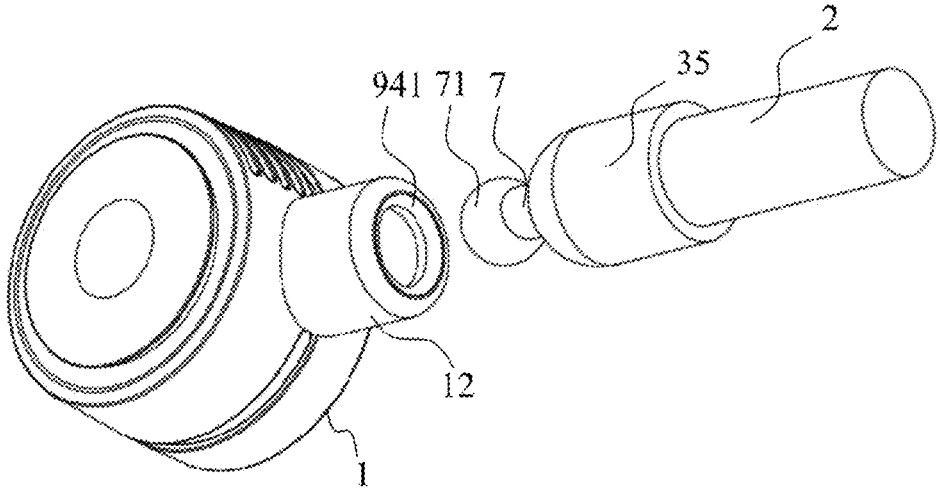
FIG. 23 shows a partial perspective view of the hanging neck fan according to yet one embodiment of the present disclosure.
Figure 24:
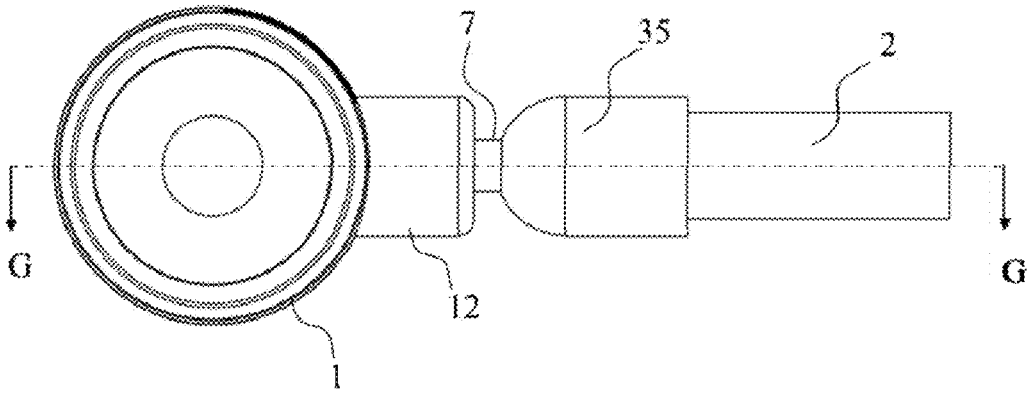
FIG. 24 shows a partial side view of the hanging neck fan according to yet one embodiment of the present disclosure.
Figure 25:
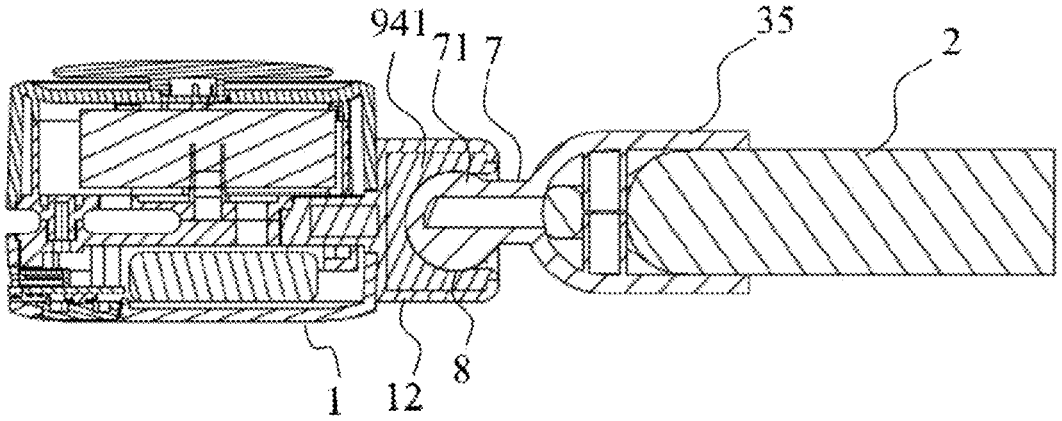
FIG. 25 shows a cross-sectional view taken along line G-G of FIG. 24.

FIGS. 23 to 25 exemplarily illustrate the hanging neck fan in yet one embodiment of the present disclosure. Unlike the previous embodiment, the spherical connecting head 71 and the spherical cavity 8 of this embodiment are coupled by a soft adhesive 941. The soft adhesive 941 is a kind of rubber, gel or plastic products that are deformable and have plasticity. For example, the soft adhesive 941 can be fixed on an inner wall of the spherical cavity 8, when the spherical connecting head 71 contacts and engages with the soft adhesive 941, the soft adhesive 941 undergoes deformation to wrap the spherical connecting head 71. One surface of the soft adhesive 941 has a certain friction force, which can fix the spherical connecting head 71 in a given position. When dismantling is necessary, the friction needs to be overcame to pull out the spherical connecting head 71.

In the embodiments of FIGS. 23 to 25, the connecting portion 35 of the connection mechanism 3 is provided with a connecting rod 7, an end of the connecting rod 7 is provided with a spherical connecting head 71. The installation portion 12 of the fan component 1 is provided with a spherical cavity 8 to accommodate the spherical connecting head 71.

Figure 26:
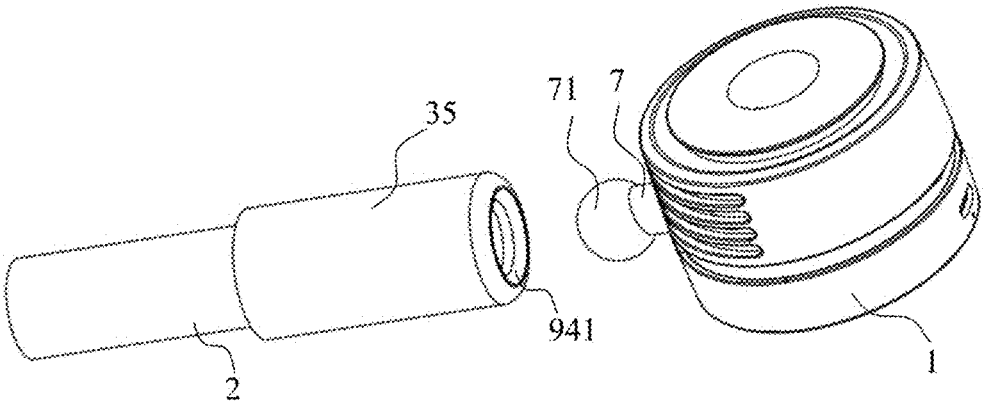
FIG. 26 shows a partial perspective view of the hanging neck fan according to yet one embodiment of the present disclosure.
Figure 27:
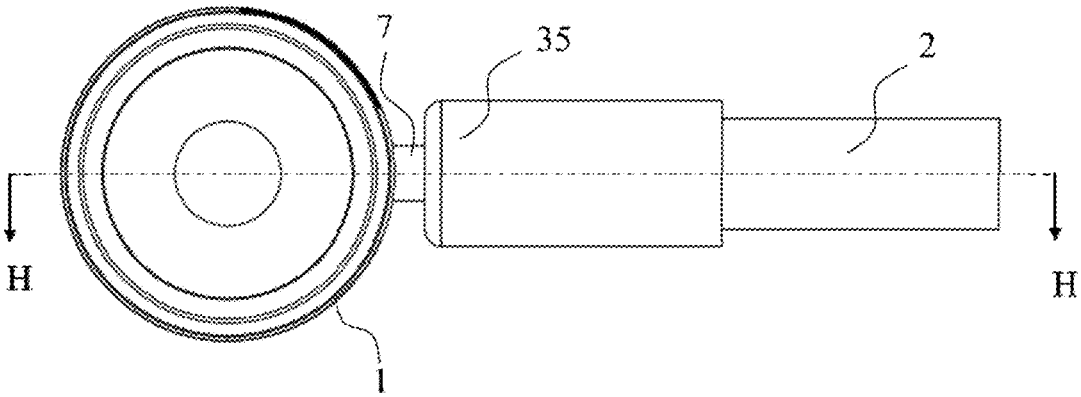
FIG. 27 shows a partial side view of the hanging neck fan according to yet one embodiment of the present disclosure.
Figure 28:
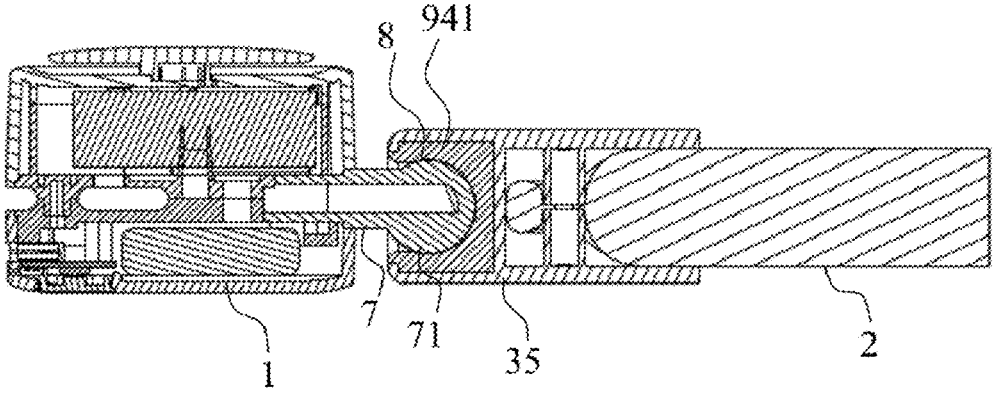
FIG. 28 shows a cross-sectional view taken along line H-H in FIG. 27.

FIGS. 26 to 28 exemplarily illustrate the hanging neck fan in yet one embodiment of the present disclosure. Unlike the previous embodiment, the spherical cavity 8 of this embodiment is provided at the connecting portion 35 of the connection mechanism 3, the connecting rod 7 and the spherical connection head 71 are provided at the installation portion 12 of the fan component 1.

Figure 29:
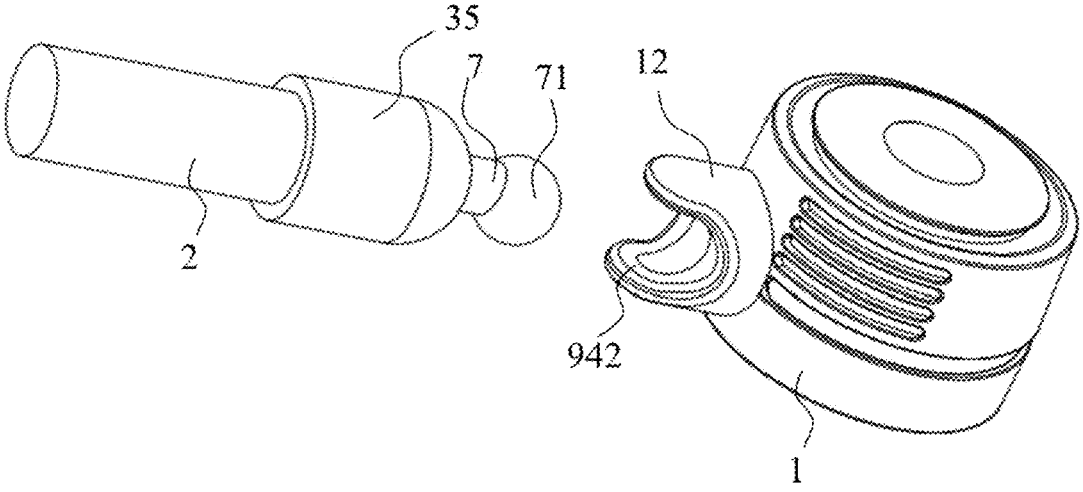
FIG. 29 shows a partial perspective view of the hanging neck fan according to yet one embodiment of the present disclosure.
Figure 30:
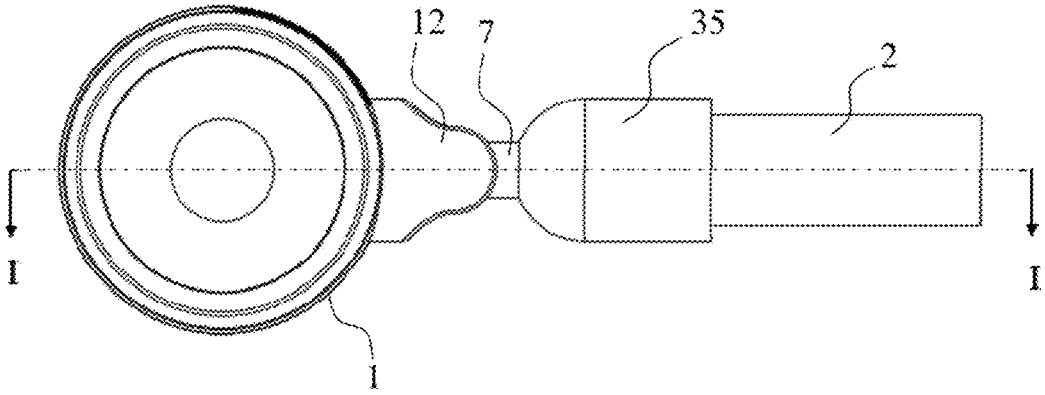
FIG. 30 shows a partial side view of the hanging neck fan according to yet one embodiment of the present disclosure.
Figure 31:
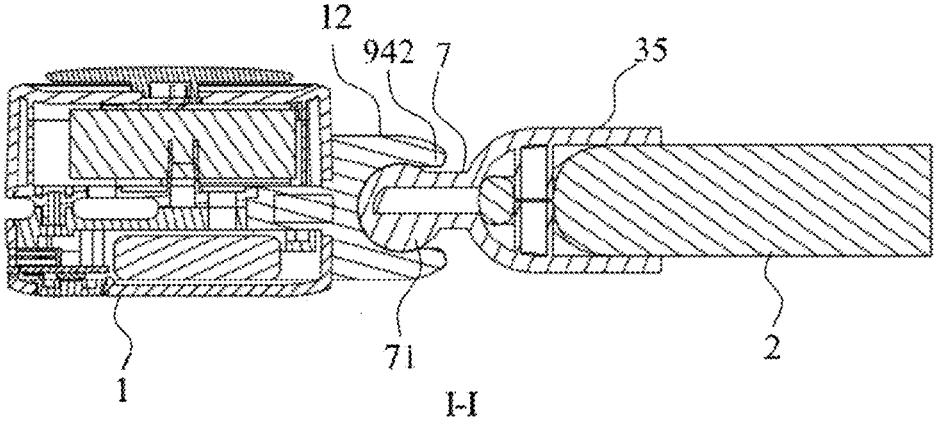
FIG. 31 shows a cross-sectional view taken along lines I-I of FIG. 30.

FIGS. 29 to 31 exemplarily illustrate the hanging neck fan in yet one embodiment of the present disclosure. Unlike the previous embodiment, the spherical connecting head 71 is clearance-fit with the spherical cavity 8 of this embodiment. In order to achieve clearance-fit dimensions, for example, an inner wall of the spherical cavity 8 can be fixedly provided with a hard plastic 942. Through the clearance-fit, this embodiment can fix the spherical connecting head 71 in a given position. When disassembling, an interference fit resistance is overcome to take out the spherical connecting head 71.

In the embodiments of FIGS. 29 to 31, the connecting portion 35 of the connection mechanism 3 is provided with a connecting rod 7, an end of the connecting rod 7 is provided with a spherical connecting head 71. The installation portion 12 of the fan component 1 is provided with a spherical cavity 8 to accommodate the spherical connecting head 71.

Figure 32:
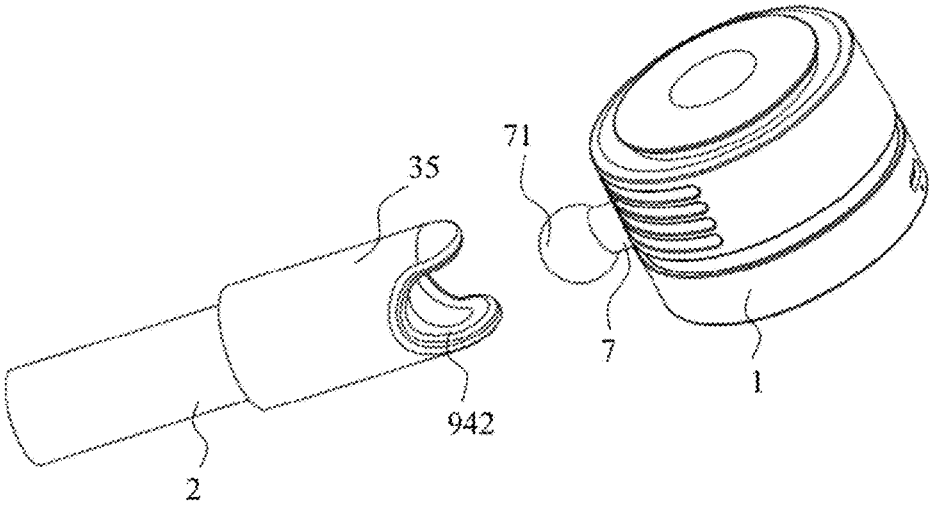
FIG. 32 shows a partial perspective view of the hanging neck fan according to yet one embodiment of the present disclosure.
Figure 33:
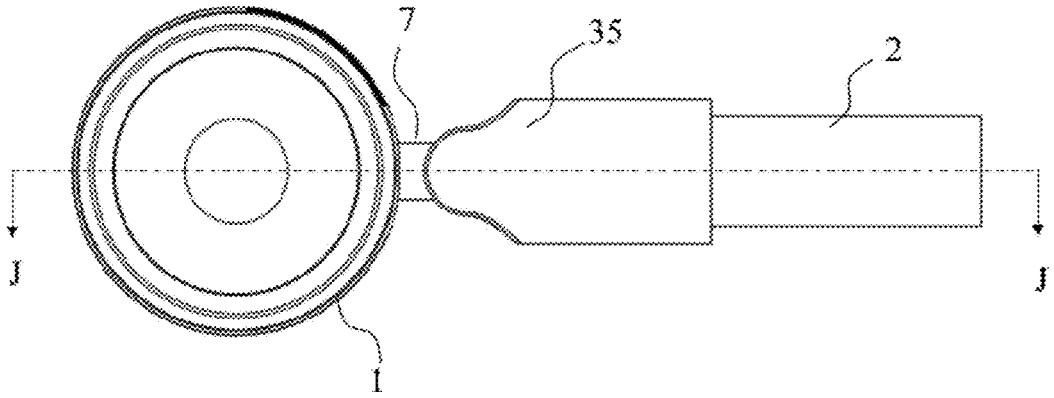
FIG. 33 shows a partial side view of the hanging neck fan according to yet one embodiment of the present disclosure.
Figure 34:
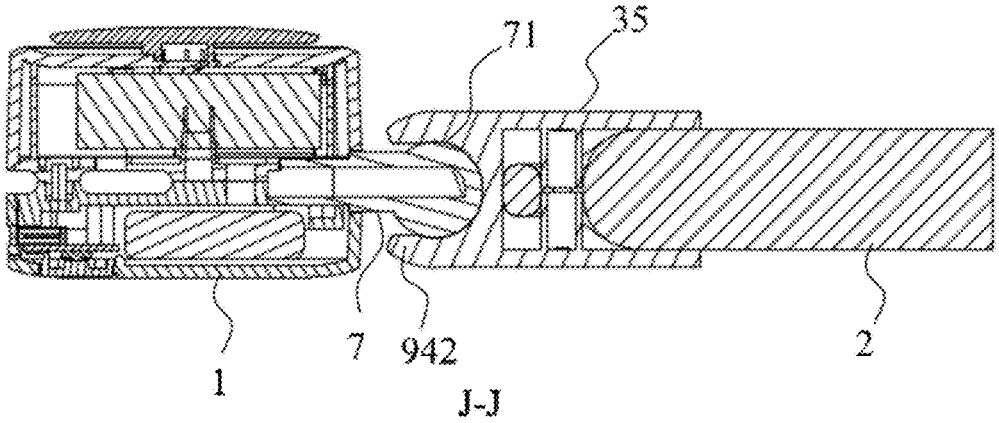
FIG. 34 shows a cross-sectional view taken along line J-J of FIG. 33.

FIGS. 32 to 34 exemplarily illustrate the hanging neck fan in yet one embodiment of the present disclosure. Unlike the previous embodiment, the spherical cavity 8 of this embodiment is provided at the connecting portion 35 of the connection mechanism 3, the connecting rod 7 and the spherical connection head 71 are provided at the installation portion 12 of the fan component 1.

Figure 35:
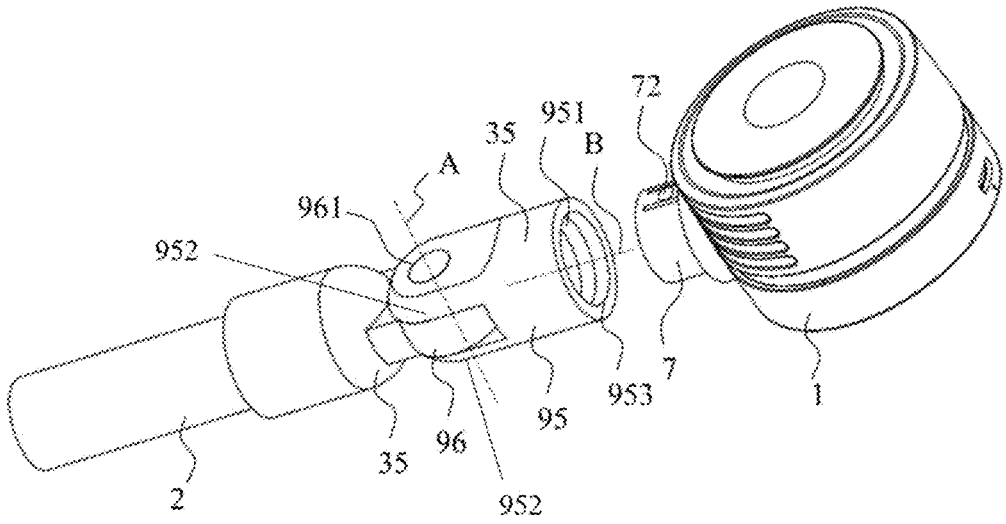
FIG. 35 shows a partial perspective view of the hanging neck fan according to yet one embodiment of the present disclosure.
Figure 36:
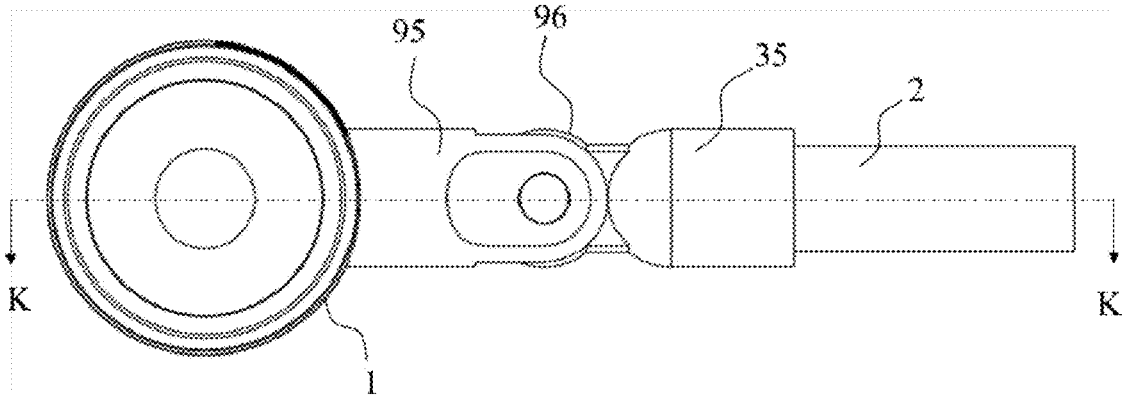
FIG. 36 shows a partial side view of the hanging neck fan according to yet one embodiment of the present disclosure.
Figure 37:
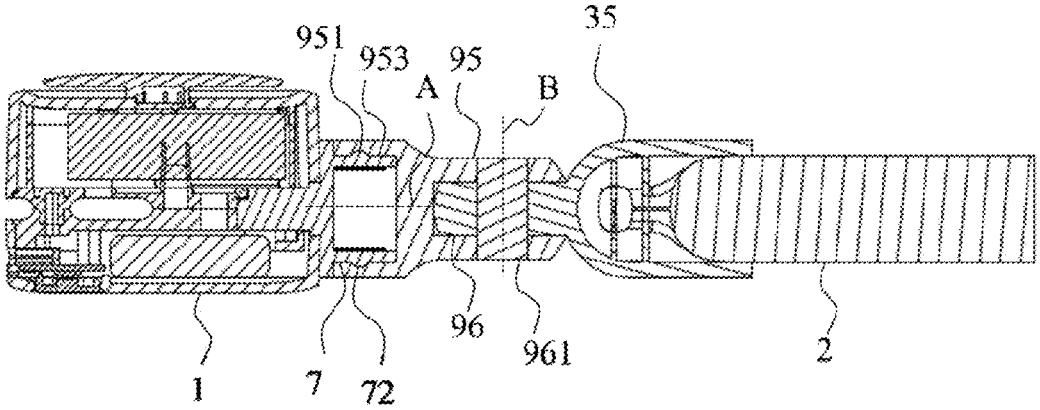
FIG. 37 shows a cross-sectional view taken along line K-K in FIG. 36.

FIGS. 35 to 37 exemplarily illustrate the hanging neck fan in yet one embodiment of the present disclosure. Unlike the aforementioned embodiments, the hanging neck fan of this embodiment further includes an intermediate connector 95, the intermediate connector 95 has a roughly cylindrical main body and is provided between the connecting portion 35 and the installation portion 12. One end of the intermediate connector 95 is provided with a pair of hinged parts 952 that are opposite to each other, an installation gap is formed between the pair of hinged parts 952. A pin hole that is intercommunicated is provided along a first axis A perpendicular to an axial direction, the other end of the intermediate connector 95 is provided with a connecting portion installation hole 953 for accommodating the connecting portion along a second axis B parallel to the axial direction.

In this embodiment, the connecting portion 35 is provided with a connecting rod 7, which can be inserted into the connecting portion installation hole 953 and rotated along the second axis B. The connecting rod 7 can be provided with a locking structure, the locking structure is configured to prevent the connecting rod 7 from separating from the connecting portion installation hole 953 after it is inserted into the connecting portion installation hole 953. In this embodiment, the locking structure may include a protrusion 72 provided on a circumferential side wall of the connecting rod 7, an inner wall of the connecting portion installation hole 953 is provided with a circular groove 951 that matches the protrusion 72.

Correspondingly, the connecting portion 35 is provided with a rotating portion 96, which is inserted into the installation gap and is provided with a through hole along the first axis A. The rotating portion 96 and the pair of hinged parts 952 are connected by a pin 961, thereby allowing the rotating portion 96 to rotate relative to the intermediate connector 95 along the first axis A.

When it is necessary to connect the fan component 1 and the connection mechanism 3, the rotating portion 96 is firstly installed into the installation gap between the pair of hinge parts 952, and then the two are connected through a pin 961. Then, the connecting rod 7 of the fan component 1 can be inserted into the connecting portion installation hole 953. When installed in place, the protrusion 72 is clamped into the circular groove 951, so that the connecting rod 7 is difficult to separate from the connecting portion installation hole 953. The above steps can also be reversed, that is, the connecting rod 7 is firstly inserted into the connecting portion installation hole 953, and then the rotating portion 96 is installed into the installation gap between the pair of hinged parts 952.

After installation, the fan component 1 and the connection mechanism 3 can rotate around the first axis A by adjusting the rotating portion 96 and the pair of hinge parts 952, or rotate around the second axis B by adjusting the connecting rod 7, so that a spatial angle between the fan component 1 and connection mechanism 3 can be flexibly and freely adjusted the degrees in the two axes.

Figure 38:
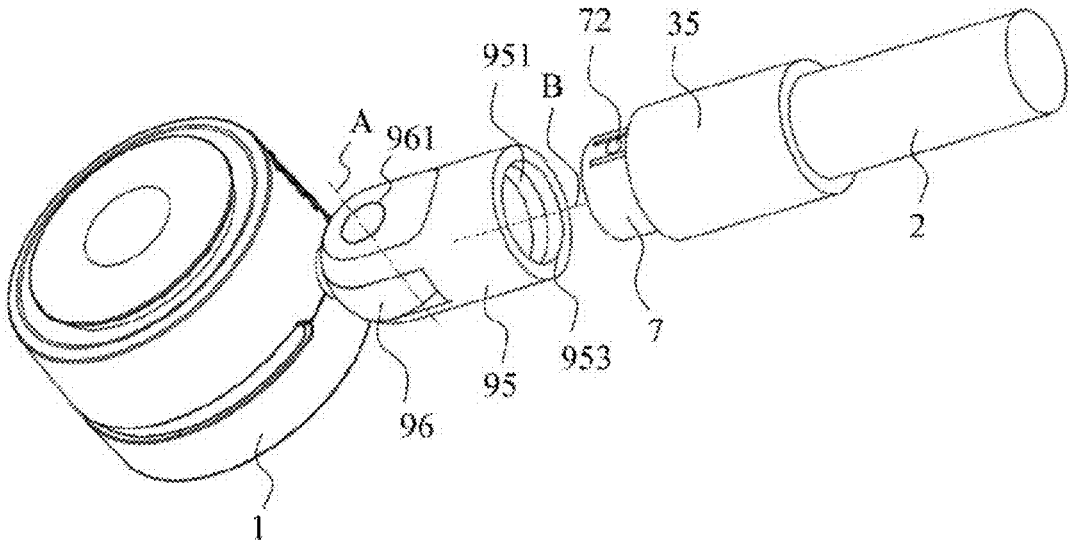
FIG. 38 shows a partial perspective view of the hanging neck fan according to yet one embodiment of the present disclosure.
Figure 39:
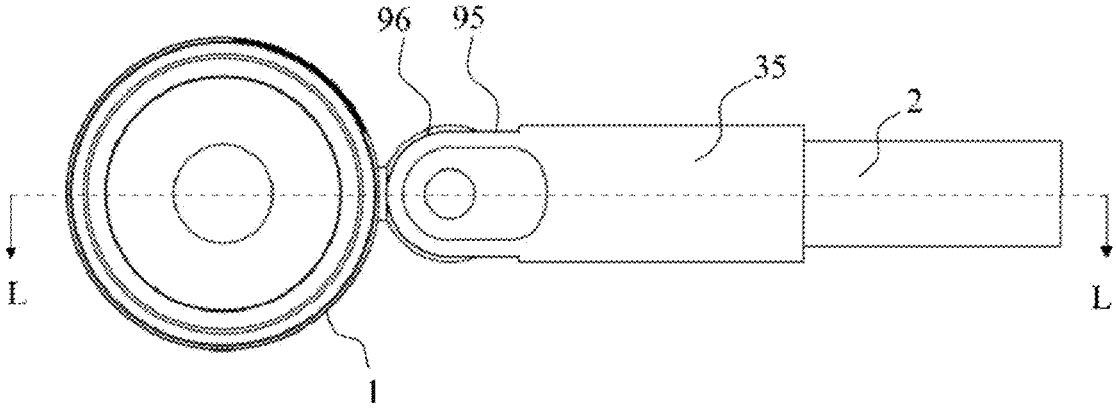
FIG. 39 shows a partial side view of the hanging neck fan according to yet one embodiment of the present disclosure.
Figure 40:
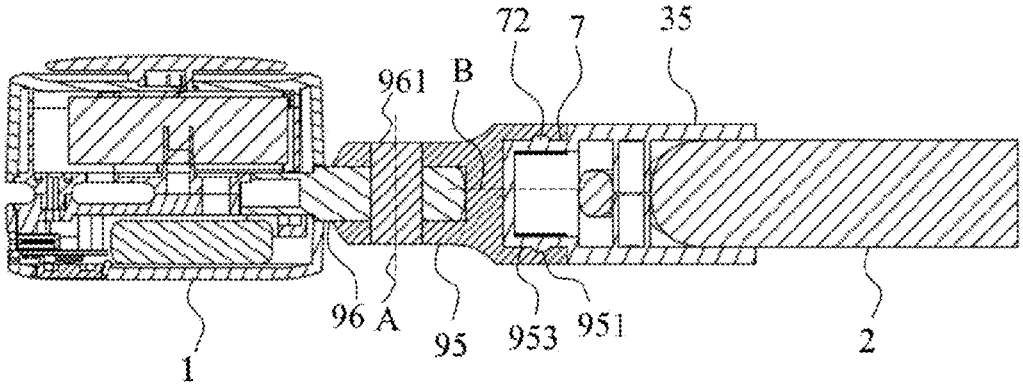
FIG. 40 shows a cross-sectional view taken along line L-L of FIG. 39.

FIGS. 38 to 40 exemplarily illustrate the hanging neck fan in yet one embodiment of the present disclosure. Unlike the previous embodiment, the connecting rod 7 of this embodiment is provided at the connecting portion 35 of the connecting module 3, the rotating portion 96 is provided at the installation portion 12 of the fan component 1.

Figure 41:
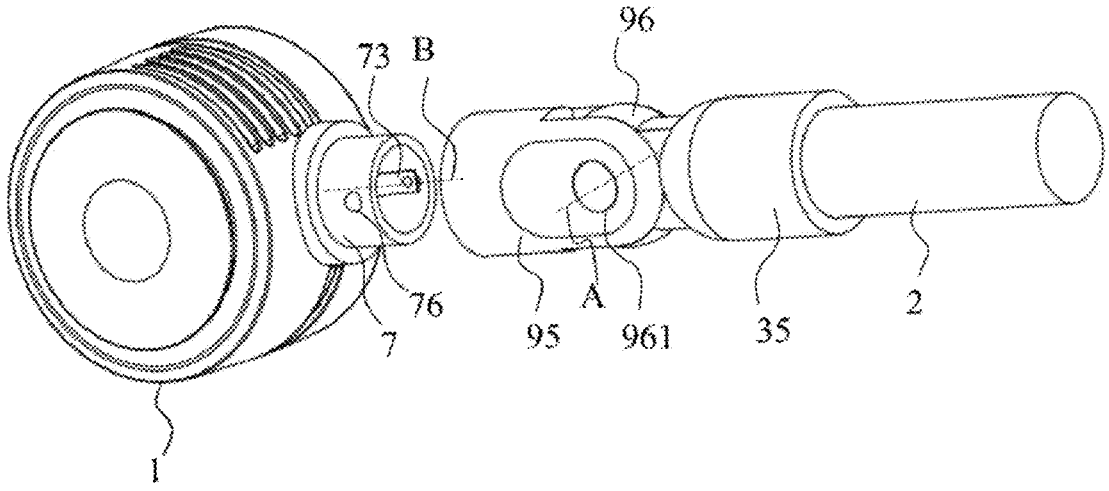
FIG. 41 shows a partial perspective view of the hanging neck fan according to yet one embodiment of the present disclosure.
Figure 42:
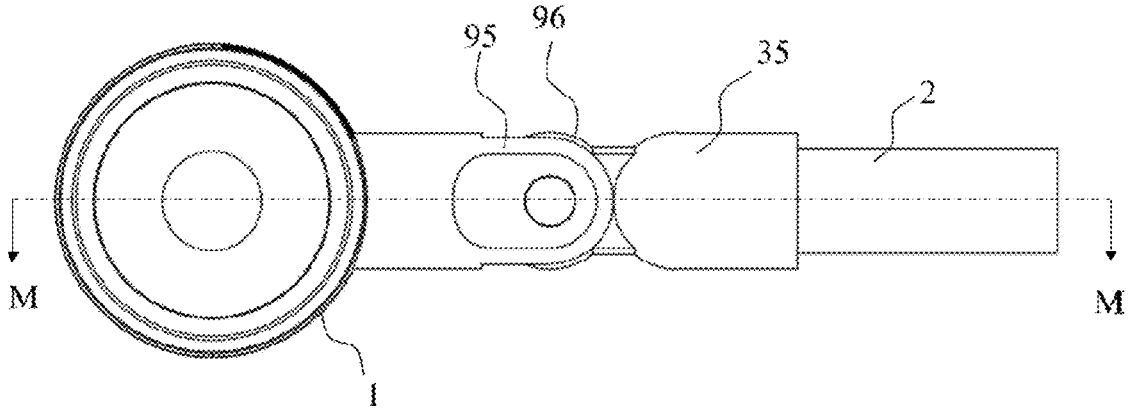
FIG. 42 shows a partial side view of the hanging neck fan according to yet one embodiment of the present disclosure.
Figure 43:
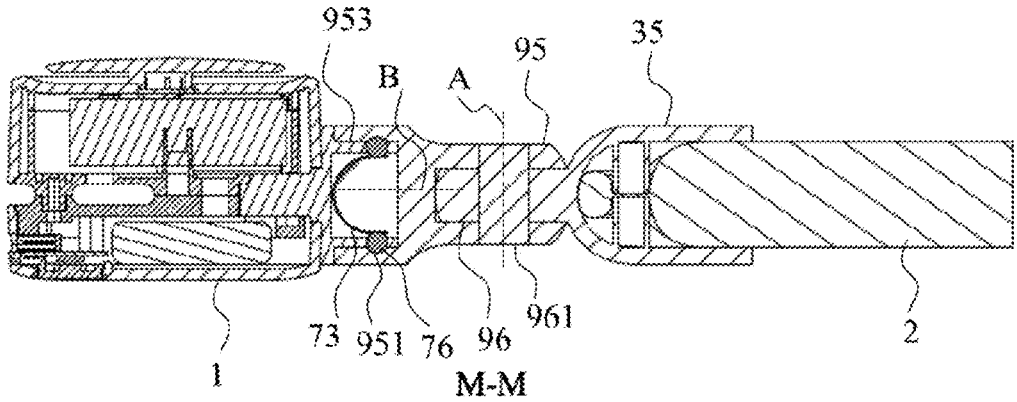
FIG. 43 shows a cross-sectional view taken along line M-M of FIG. 42.

FIGS. 41 to 43 exemplarily illustrate the hanging neck fan in yet one embodiment of the present disclosure. Unlike the aforementioned embodiments, the locking structure includes at least one through hole provided on a circumferential sidewall of the connecting rod 7, at least one steel ball 76 capable of passing through the through hole, and a reset elastic member 73 connected to at least one steel ball 76. The reset elastic member 73 applies an elastic force protruding from the through hole to the steel ball 76. In this embodiment, the locking structure includes two steel balls 76, the reset elastic member 73 can be a plate spring, leaf spring, disc spring, annular spring, or rubber elastic ring, etc., two ends of the reset elastic member 73 are connected to the two steel balls 76. In an implementation mode, a diameter of the through hole is less than a diameter of steel ball 76 and greater than half of the diameter of the steel ball 76, a depth of the through hole is also less than the diameter of steel ball 76, allowing at least part of the steel ball 76 to be exposed from the circumferential sidewall of the connecting rod 7.

Correspondingly, an inner wall of the connecting portion installation hole 953 is provided with a circular groove 951 that matches the steel ball 76.

When it is necessary to connect the fan component 1 and the connection mechanism 3, the connecting rod 7 is firstly inserted into the connecting portion installation hole 953. The steel ball 76 will be shrunk into the circumferential side wall of the connecting rod 7 under a constraint of the connecting portion installation hole 953, the connecting rod 7 will be installed in place. At this point, the steel ball 76 matches and is clamped into the circular groove 951. Due to an elastic force applied by the reset elastic member 73 to the steel ball 76, the steel ball 76 remains in the circular groove 951, which hinders the connecting rod 7 from sliding out of the connecting portion installation hole 953. The steps for installing the rotating portion 96 at the other end into the installation gap between the pair of hinged parts 952 are the same as the previous embodiment, and will not be repeated here.

In this embodiment, the rotating portion 96 is provided at the connecting portion 35 of the connecting module 3, the connecting rod 7 is provided at the installation portion 12 of the fan component 1.

Figure 44:
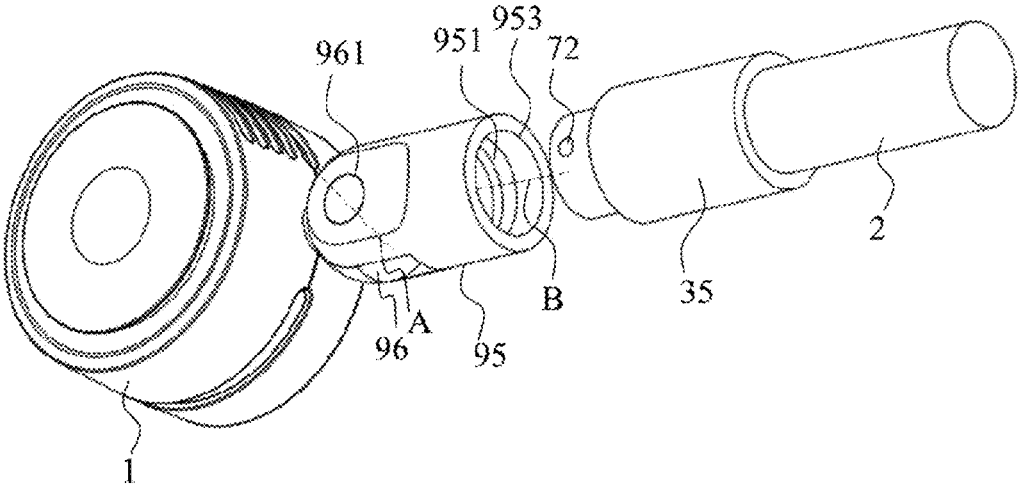
FIG. 44 shows a partial perspective view of the hanging neck fan according to yet one embodiment of the present disclosure.
Figure 45:
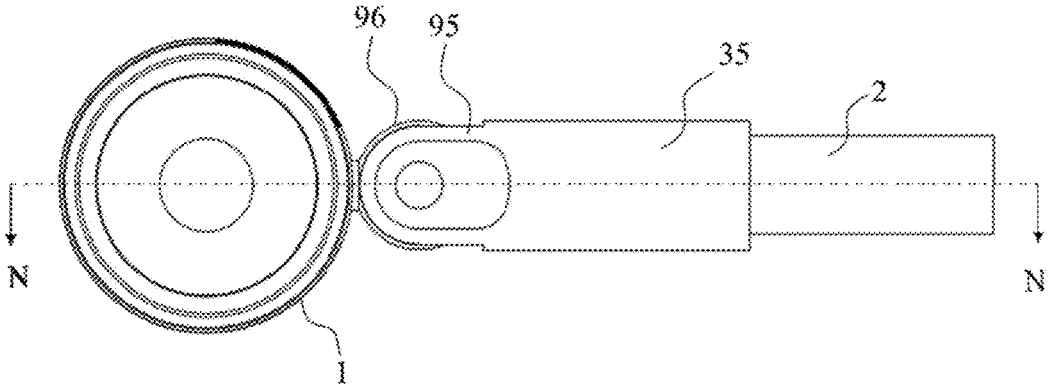
FIG. 45 shows a partial side view of the hanging neck fan according to yet one embodiment of the present disclosure.
Figure 46:
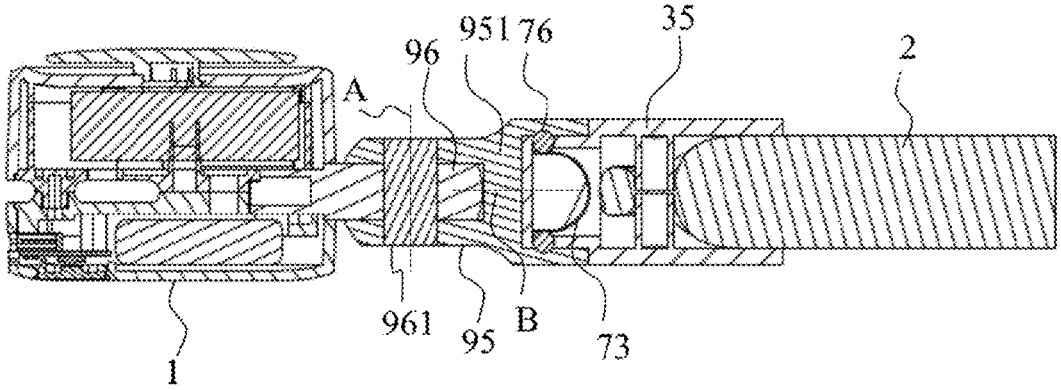
FIG. 46 shows a cross-sectional view taken along line N-N of FIG. 45.

FIGS. 44 to 46 exemplarily illustrate the hanging neck fan in yet one embodiment of the present disclosure. Unlike the previous embodiment, the connecting rod 7 of this embodiment is provided at the connecting portion 35 of the connection mechanism 3, the rotating portion 96 is provided at the installation portion 12 of the fan component 1.

Figure 47:
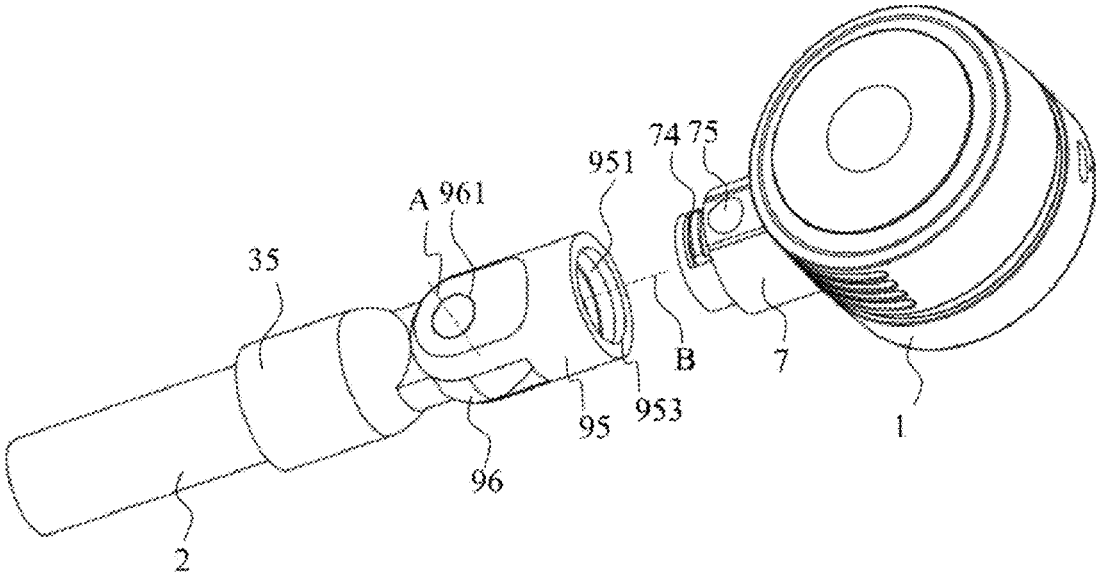
FIG. 47 shows a partial perspective view of the hanging neck fan according to yet one embodiment of the present disclosure.
Figure 48:
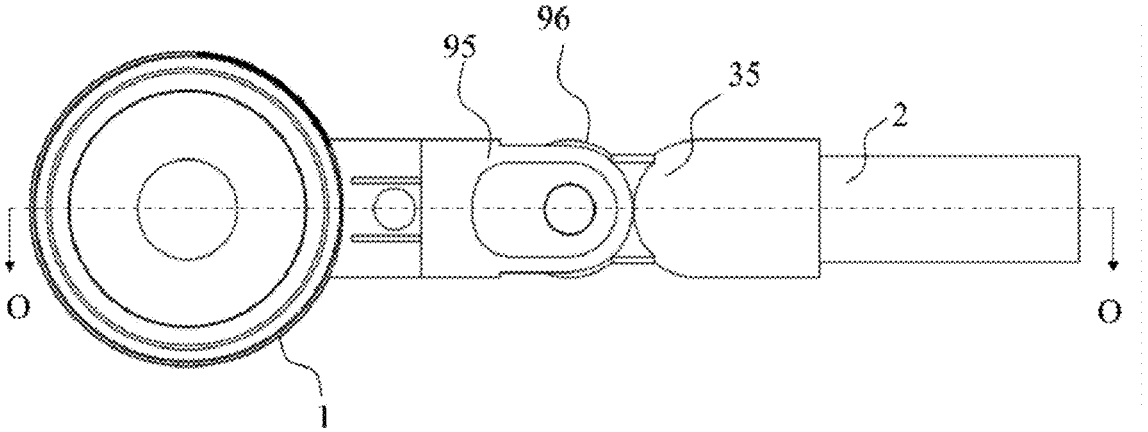
FIG. 48 shows a partial side view of the hanging neck fan according to yet one embodiment of the present disclosure.
Figure 49:
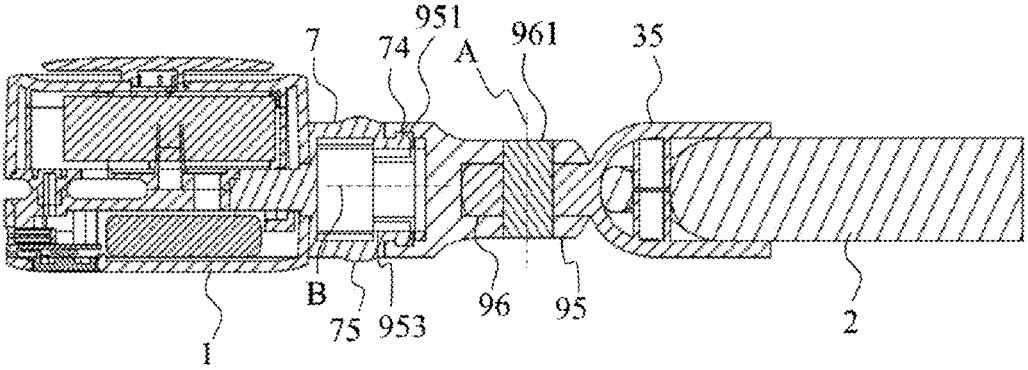
FIG. 49 shows a cross-sectional view taken along line O-O of FIG. 48.

FIGS. 47 to 49 exemplarily illustrate the hanging neck fan in ye one embodiment of the present disclosure. Unlike the aforementioned embodiments, the locking structure includes a buckle 74 provided on a circumferential side wall of the connecting rod 7, a circular groove 951 matched with the buckle 74 is provided on an inner wall of the connecting portion installation hole 953. Additionally, a deblocking button 75 is further provided on one side of the buckle 74 away from the connecting portion installation hole 953, the deblocking button 75 is connected to the buckle 74. When the deblocking button 75 is pressed, the buckle 74 is tightened radially to allow the buckle 74 to separate from the circular groove 951.

In the embodiments shown in FIGS. 47 to 49, the rotating portion 96 is provided at the connecting portion 35 of the connecting module 3, the connecting rod 7 is provided at the installation portion 12 of the fan component 1.

Figure 50:
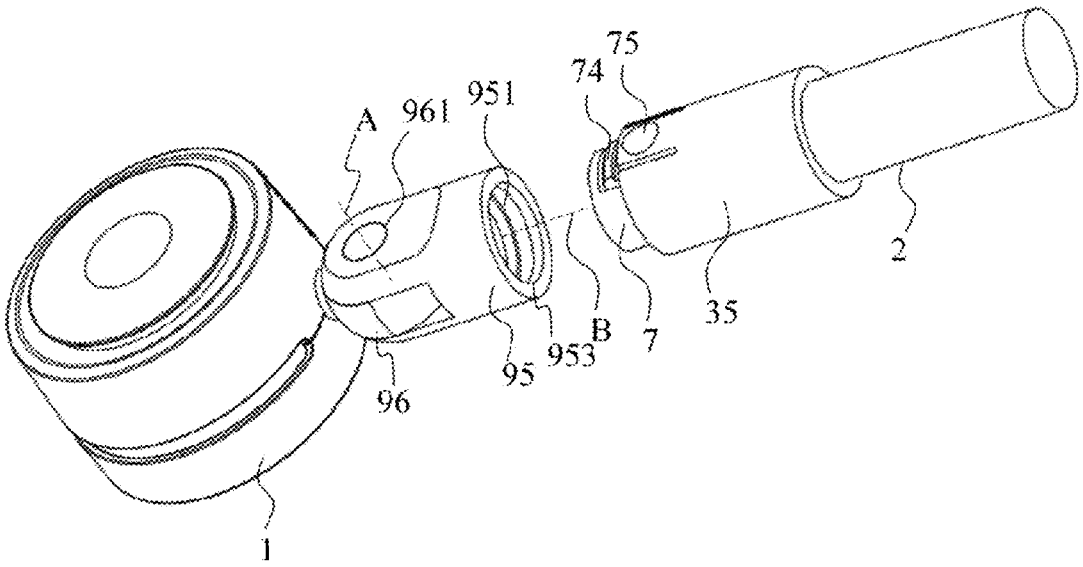
FIG. 50 shows a partial perspective view of the hanging neck fan according to yet one embodiment of the present disclosure.
Figure 51:
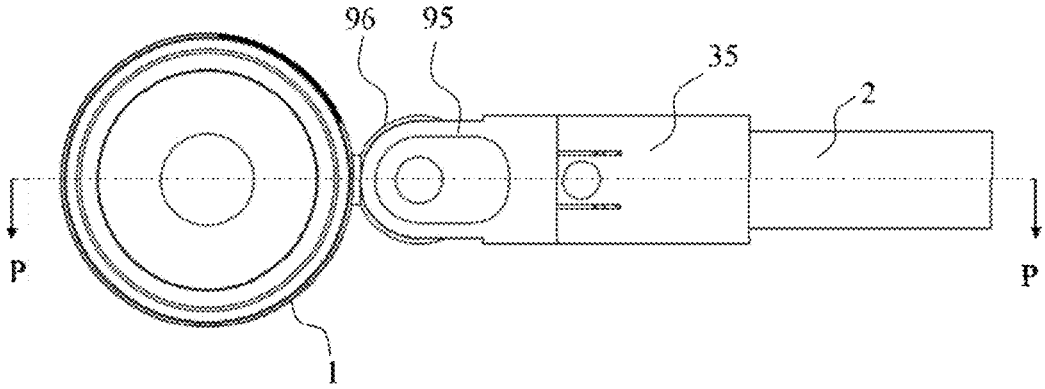
FIG. 51 shows a partial side view of the hanging neck fan according to yet one embodiment of the present disclosure.
Figure 52:
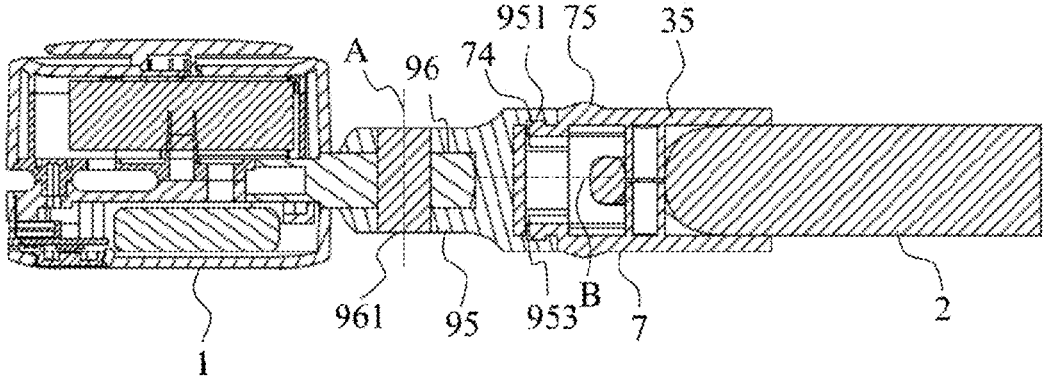
FIG. 52 shows a cross-sectional view taken along line P-P of FIG. 51.

FIGS. 50 to 52 exemplarily illustrate the hanging neck fan in yet one embodiment of the present disclosure. Unlike the previous embodiment, the connecting rod 7 of this embodiment is provided at the connecting portion 35 of the connecting module 3, the rotating portion 96 is provided at the installation portion 12 of the fan component 1.

Figure 53:
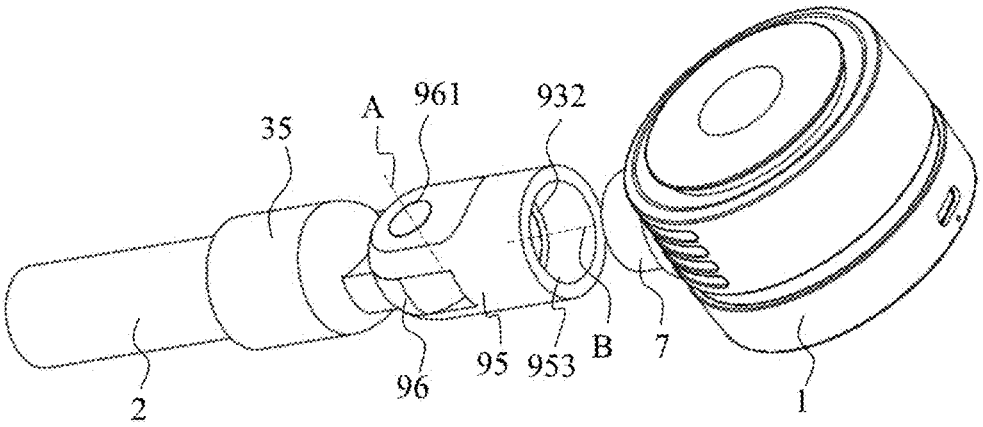
FIG. 53 shows a partial perspective view of the hanging neck fan according to yet one embodiment of the present disclosure.
Figure 54:
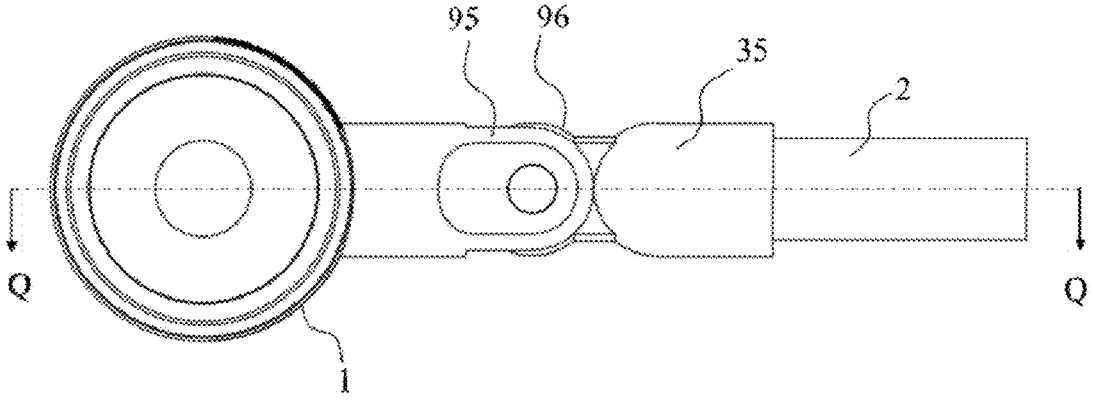
FIG. 54 shows a partial side view of the hanging neck fan according to yet one embodiment of the present disclosure.
Figure 55:
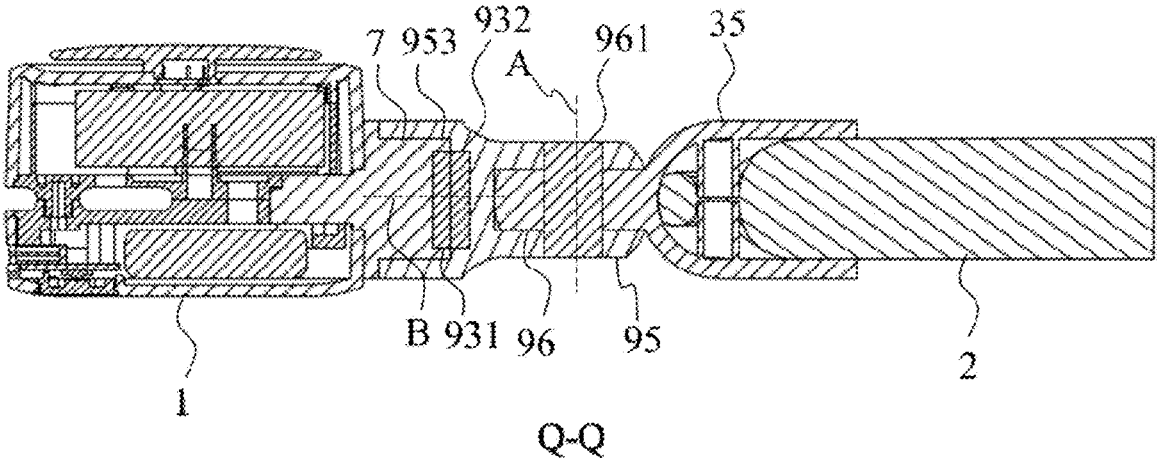
FIG. 55 shows a cross-sectional view taken along line Q-Q of FIG. 54.
Figure 56:
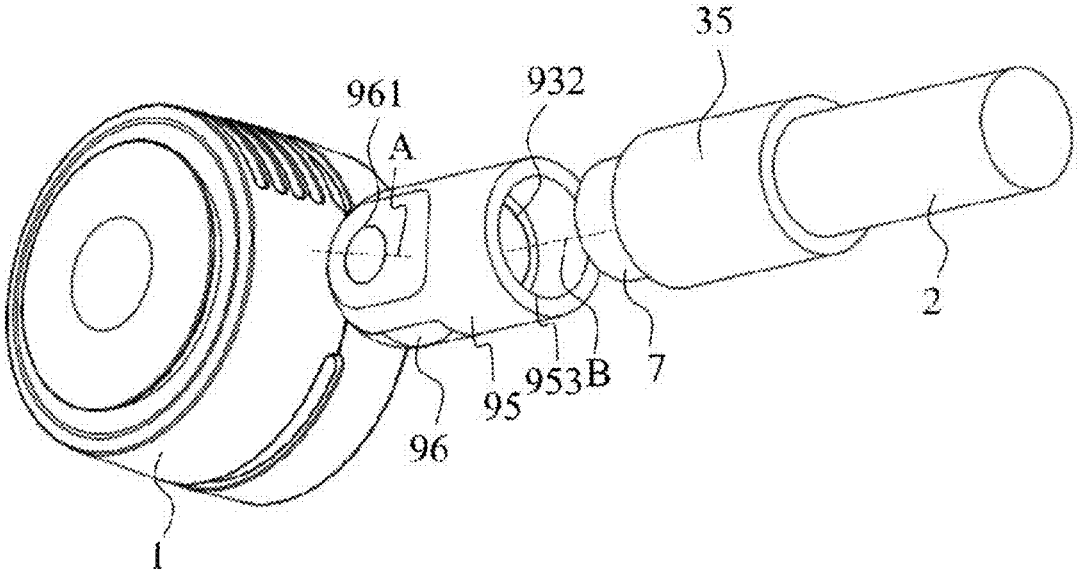
FIG. 56 shows a partial perspective view of the hanging neck fan according to yet one embodiment of the present disclosure.
Figure 57:
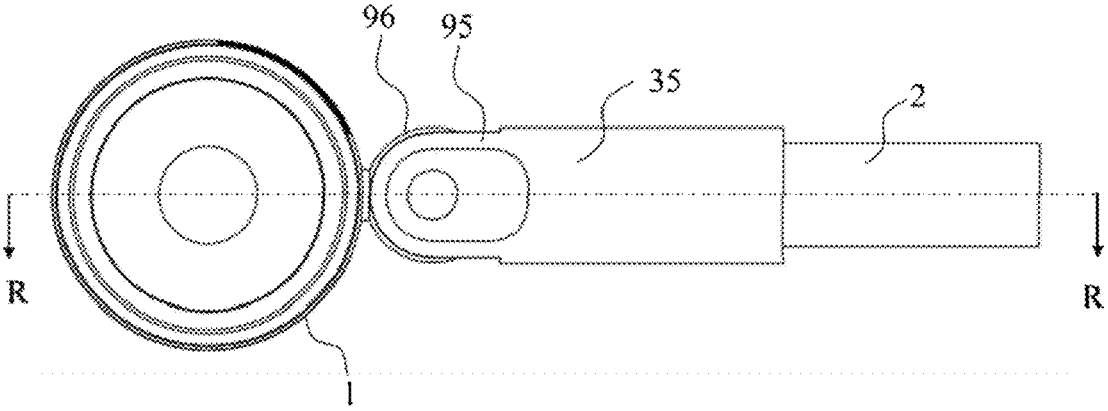
FIG. 57 shows a partial side view of the hanging neck fan according to yet one embodiment of the present disclosure.
Figure 58:
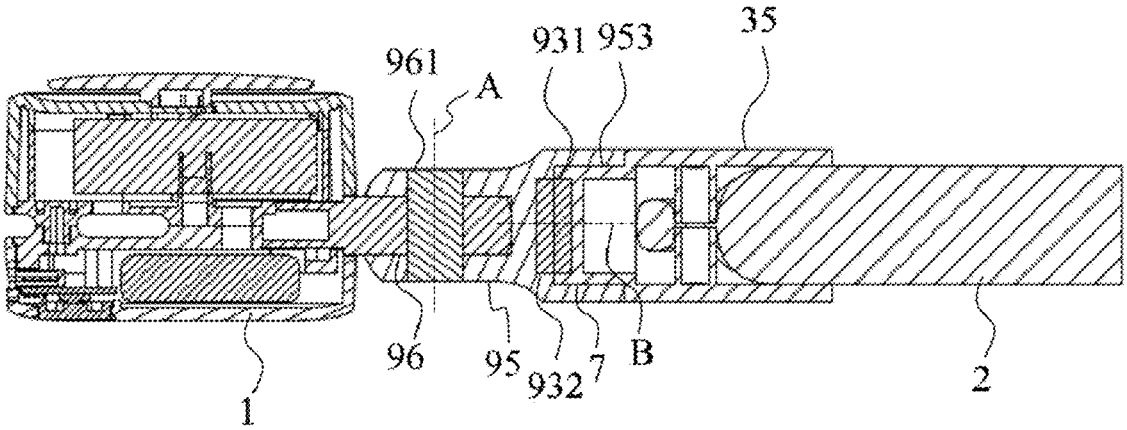
FIG. 58 shows a cross-sectional view taken along line R-R of FIG. 57.

FIGS. 53 to 55 exemplarily illustrate the hanging neck fan in yet one embodiment of the present disclosure. Unlike the aforementioned embodiments, the locking structure includes a magnet 931 provided at an end of the connecting rod 7, another magnet 932 opposite to the magnetic pole of the magnet 931 is provided on a bottom wall of the connecting portion installation hole 953. In an implementation mode, a bottom wall of the connecting portion installation hole 953 can be provided with an iron block or other iron element. Therefore, an end of the connecting rod 7 and the bottom wall of connecting portion installation hole 953 are attracted by magnetic force. When disassembly is required, the magnetic force is overcome to separate the connecting rod 7 from connecting portion the installation hole 953.

The following clauses provide an example of the hanging neck fan disclosed in this specification.

Clause 1: a hanging neck fan, including:

a fan component, which includes a fan body and an installation portion provided on one side of the fan body;

a hanging neck component, configured to wear at a human's neck, the hanging neck component is filled with a heat absorbing medium, the hanging neck component includes a first end, a second end, and an arc-shaped main body between the first end and the second end that are sealed with each other; at least one of the first end and the second end is provided with an installation hole; and at least one connection mechanism, the at least one connection mechanism connects the fan component and the hanging neck component, the at least one connection mechanism includes a first portion and a second portion, the first portion is detachably connected to the hanging neck component, a second portion is detachably connected to the installation portion of the fan component, the first portion is provided with an installation column that partially passes through the installation holes of the first end and/or the second end.

Clause 2: the hanging neck fan according to clause 1, the at least one connection mechanism is formed by enclosing two half shells, at least one of the two half shells is provided with an installation column at the first portion and a connecting portion at the second portion, the connecting portion is configured to be detachably connected to the installation portion of the fan component.

Clause 3: the hanging neck fan according to clause 1 or 2, the installation hole is a through hole, the installation column passes through the through hole and fits with an inner wall of the through hole.

Clause 4: the hanging neck fan according to clause 1 or 2, the installation hole is a stepped hole structure, the stepped hole structure includes a first counter bore portion, a second counter bore portion, and a through-hole portion between the first counter bore portion and the second counter bore portion; a diameter of the through-hole portion is smaller than that of the first counter bore portion and the second counter bore portion and thereby forming a flange between the through-hole portion with the first counter bore portion and/or the second counter bore portion, the installation column abuts against at least one surface of the flange, or the installation column passes through the through-hole portion.

Clause 5: the hanging neck fan according to clause 2, one of the connecting portion and the installation portion is provided with a connecting rod, one end of the connecting rod is provided with a spherical connecting head, the other of the connecting portion and the installation portion is provided with a spherical cavity to accommodate the spherical connecting joint, the hanging neck fan further includes a locking structure, the spherical connecting head and the spherical cavity are locked or unlocked with each other through the locking structure, the spherical connecting head is fixed in the spherical cavity when locked, and the spherical connecting head can rotate or separate from the spherical cavity when unlocked.

Clause 6: the hanging neck fan according to clause 5, the locking structure includes an external thread where at least a part of the external thread surrounds the spherical cavity, and a nut that fits with the external thread, the spherical connecting head is accommodated in the spherical cavity, engages with the external thread and be locked through the nut, the external thread has multiple grooves distributed along a circumference, the multiple grooves extend along an axial direction so that the external thread is tightened radially to fix the spherical connecting head in the spherical cavity when locked.

Clause 7: the hanging neck fan according to clause 5, the installation portion is provided with a connecting rod, the connecting portion is provided with a spherical cavity, the connecting portion is provided with a sliding groove along an axial direction and a movable slider in the sliding groove, the slider can move between a locking position and an unlocking position, the slider can be coupled with the spherical connecting head of the connecting rod and hinder the spherical connecting head to separate from the spherical cavity when in the locking position;

the slider can separate from the spherical connecting head of the connecting rod and the spherical connecting head can rotate or separate from the spherical cavity when in the unlocking position.

Clause 8: the hanging neck fan according to clause 5, the locking structure includes a magnet provided in the spherical cavity, the spherical connecting head is made of iron material, the spherical connecting head is placed into the spherical cavity and magnetically attracted to the magnet in the spherical cavity.

Clause 9: the hanging neck fan according to clause 2, one of the connecting portion and the installation portion is provided with a connecting rod, one end of the connecting rod is provided with a spherical connecting head, the other of the connecting portion and the installation portion is provided with a spherical cavity to accommodate the spherical connecting head, the spherical connecting head is clearance-fit with the spherical cavity or coupled with the spherical cavity by a soft adhesive.

Clause 10: the hanging neck fan according to clause 1, the heat absorbing medium is a phase change material, gel material or oil.

Clause 11: the hanging neck fan according to clause 2, further including: an intermediate connector, the intermediate connector has a roughly cylindrical main body and is arranged between the connecting portion and the installation portion, one end of the intermediate connector is provided with a pair of hinged parts that are opposite to each other, an installation gap is formed between the pair of hinged parts, a pin hole that is intercommunicated is provided along a first axis perpendicular to an axial direction, the other end of the intermediate connector is provided with a connecting portion installation hole to accommodate the connecting portion along a second axis parallel to the axial direction, one of the connecting portions and the installation portion is provided with a connecting rod, which can be inserted into the connecting portion installation hole and rotate along the second axis; the connecting rod is provided with a locking structure, which is configured to prevent the connecting rod from separating from the connecting portion installation hole after the connecting rod is inserted into the connecting portion installation hole;

the other of the connecting portions and the installation portion is provided with a rotating portion, which is installed in the installation gap and is provided with a through hole along the first axis; the rotating portion and the pair of hinged parts are connected by a pin, so that the rotating portion can rotate relative to the intermediate connector along the first axis.

Clause 12: the hanging neck fan according to clause 11, the locking structure includes a protrusion provided on a circumferential side wall of the connecting rod, an inner wall of the connecting portion installation hole is provided with a circular groove that matches the protrusion.

Clause 13: the hanging neck fan according to clause 11, the locking structure includes at least one through hole provided on a circumferential side wall of the connecting rod, at least one steel ball capable of passing through the through hole, a reset elastic member connected to the at least one steel ball; an inner wall of the connecting portion installation hole is provided with an annular groove that matches the at least one steel ball, the reset elastic member applies an elastic force protruding from the through hole to the steel ball so that the steel ball fits with the annular groove when installed in position.

Clause 14: the hanging neck fan according to clause 11, the locking structure includes a buckle provided on a circumferential side wall of the connecting rod, an inner wall of the connecting portion installation hole is provided with a circular groove that matches the buckle, a deblocking button is further provided on a side of the buckle away from the connecting portion installation hole; the deblocking button is connected to the buckle, so that when the deblocking button is pressed, the buckle is tightened radially to allow the buckle to separate from the circular groove.

Clause 15: the hanging neck fan according to clause 11, the locking structure includes a magnet provided at an end of the connecting rod, a bottom wall of the connecting portion installation hole is provided with an iron block or another magnet with opposite magnetic poles.

The exemplary embodiment of the hanging neck fan proposed in the present disclosure has been described in detail with reference to the embodiments in the specification. However, those skilled in the art can understand that multiple variations and modifications can be made to the specific embodiment without departing from the concept of the present disclosure. In addition, various technical features and structures proposed in various aspects of the present disclosure can also be combined in multiple ways, without exceeding the protection scope of the present disclosure, which is determined by the attached claims.

NUMBER REFERENCE

1 Fan component
11 Fan body
111 Fan blade assembly
112 Drive motor
12 Installation portion
13 Air inlet
14 Air outlet
15 Upper cover
2 Hanging neck component
21 First End
22 Second end
23 Arc-shaped main body
3 Connection mechanism
31 First portion
32 Second portion
33 First shell
34 Second shell
35 Connecting portion
4 Heat absorbing medium
5 Installation hole
51 First counter bore portion
52 Second counter bore portion
53 Through-hole portion
54 Flange
6 Installation column
61 First installation column
62 Second installation column
63 Third installation column
7 Connecting rod
71 Spherical connecting head
72 Protrusion
73 Reset elastic member
74 Buckle
75 Deblocking button
76 Steel ball
8 Spherical cavity
9 Locking structure
911 External thread
912 Nut
913 Groove
921 Sliding groove
922 Slider
931, 932 Magnet
941 Soft adhesive
942 Hard plastic
95 Intermediate connector
951 Circular groove
952 Hinged part
953 Connecting portion installation hole
96 Rotating portion
961 Pin
A First axis
B Second axis

What is claimed is:

1. A hanging neck fan, comprising:

a fan component, which comprises a fan body and an installation portion provided on one side of the fan body;

a hanging neck component, configured to wear at a human's neck, wherein the hanging neck component is filled with a heat-absorbing medium: the hanging neck component comprises a first end, a second end, and an arc-shaped main body between the first end and the second end that are sealed with each other; at least one of the first end and the second end is provided with an installation hole; and at least one connection mechanism, wherein the at least one connection mechanism connects the fan component and the hanging neck component, the at least one connection mechanism comprises a first portion and a second portion, the first portion is detachably connected to the hanging neck component, the second portion is detachably connected to the installation portion of the fan component, wherein the first portion is provided with an installation column that partially passes through the installation hole of the first end and/or the second end;

wherein the at least one connection mechanism is formed by enclosing two half shells, at least one of the two half shells is provided with the installation column at the first portion and a connecting portion at the second portion, the connecting portion is configured to be detachably connected to the installation portion of the fan component.

2. The hanging neck fan according to claim 1, wherein the installation hole is a through hole, the installation column passes through the through hole and fits with an inner wall of the through hole.

3. The hanging neck fan according to claim 1, wherein the installation hole is a stepped hole structure, the stepped hole structure comprises a first counter bore portion, a second counter bore portion, and a through-hole portion between the first counter bore portion and the second counter bore portion: a diameter of the through-hole portion is smaller than that of the first counter bore portion and the second counter bore portion, and thereby forming a flange between the through-hole portion with the first counter bore portion and/or the second counter bore portion, wherein the installation column abuts against at least one surface of the flange, or the installation column passes through the through-hole portion.

4. The hanging neck fan according to claim 1, wherein one of the connecting portion and the installation portion is provided with a connecting rod, one end of the connecting rod is provided with a spherical connecting head, the other of the connecting portion and the installation portion is provided with a spherical cavity to accommodate the spherical connecting head, wherein the hanging neck fan further comprises a locking structure, the spherical connecting head and the spherical cavity are locked or unlocked with each other through the locking structure; the spherical connecting head is fixed in the spherical cavity when locked, and the spherical connecting head can rotate or separate from the spherical cavity when unlocked.

5. The hanging neck fan according to claim 4, wherein the locking structure comprises an external thread where at least a part of the external thread surrounds the spherical cavity, and a nut that fits with the external thread: the spherical connecting head is accommodated in the spherical cavity, engages with the external thread and be locked through the nut, wherein the external thread has multiple grooves distributed along a circumference, the multiple grooves extend along an axial direction so that the external thread is tightened radially to fix the spherical connecting head in the spherical cavity when locked.

6. The hanging neck fan according to claim 4, wherein the installation portion is provided with the connecting rod, the connecting portion is provided with the spherical cavity, the connecting portion is provided with a sliding groove along an axial direction and a movable slider in the sliding groove, the slider can move between a locking position and an unlocking position, the slider can be coupled with the spherical connecting head of the connecting rod and hinder the spherical connecting head to separate from the spherical cavity when in the locking position;

the slider can separate from the spherical connecting head of the connecting rod and the spherical connecting head can separate from the spherical cavity when in the unlocking position.

7. The hanging neck fan according to claim 4, wherein the locking structure comprises a magnet provided in the spherical cavity, the spherical connecting head is made of iron material, wherein the spherical connecting head is placed into the spherical cavity and magnetically attracted to the magnet in the spherical cavity.

8. The hanging neck fan according to claim 1, wherein the spherical connecting head is clearance-fit with the spherical cavity or coupled with the spherical cavity by a soft adhesive.

9. The hanging neck fan according to claim 1, wherein the heat-absorbing medium is phase change material, gel material or oil.

* * * * *